US007868526B2

(12) United States Patent
Matsushita et al.

(10) Patent No.: US 7,868,526 B2
(45) Date of Patent: Jan. 11, 2011

(54) LIGHT SOURCE DEVICE

(75) Inventors: Koji Matsushita, Hamamatsu (JP); Kazuo Ueno, Hamamatsu (JP); Kouzou Adachi, Hamamatsu (JP)

(73) Assignee: Hamamatsu Photonics K. K., Hamamatsu-shi, Shizuoka (JP)

( * ) Notice: Subject to any disclaimer, the term of this patent is extended or adjusted under 35 U.S.C. 154(b) by 351 days.

(21) Appl. No.: 11/884,001

(22) PCT Filed: Feb. 10, 2006

(86) PCT No.: PCT/JP2006/302362

§ 371 (c)(1),
(2), (4) Date: Aug. 9, 2007

(87) PCT Pub. No.: WO2006/087975

PCT Pub. Date: Aug. 24, 2006

(65) Prior Publication Data

US 2008/0180027 A1 Jul. 31, 2008

(30) Foreign Application Priority Data

Feb. 17, 2005 (JP) ..... 2005-041186

(51) Int. Cl.

| | |
|---|---|
| ***H01J 7/24*** | (2006.01) |
| *F21V 21/00* | (2006.01) |
| *F21V 29/00* | (2006.01) |
| *H01J 17/16* | (2006.01) |

(52) U.S. Cl. ..... 313/44; 313/25; 313/46; 313/49; 313/318.01; 313/634; 362/294

(58) Field of Classification Search ..... 362/3–30
See application file for complete search history.

(56) References Cited

U.S. PATENT DOCUMENTS

2002/0054493 A1* 5/2002 Sei et al. ..... 362/373

(Continued)

FOREIGN PATENT DOCUMENTS

JP 58-13688 1/1983

(Continued)

OTHER PUBLICATIONS

Machine translation of JP 2001-176304, JP 6-60019 and JP 2001-256924.*

*Primary Examiner*—Peter J Macchiarolo
*Assistant Examiner*—Jacob Stern
(74) *Attorney, Agent, or Firm*—Drinker Biddle & Reath LLP

(57) ABSTRACT

The present invention relates to a light source apparatus with a structure that enables the brightness of a gas discharge tube to be stabilized and facilitates gas discharge tube maintenance work. The light source apparatus has a gas discharge tube, a lamp container housing the gas discharge tube, and a base on which the lamp container is fixed. The gas discharge tube is fixed via a heat insulating member to a portion of an outer shell of the lamp container, and the heat insulating member functions to reduce heat transfer between the lamp container and the gas discharge tube to reduce the influence of temperature change, outside the lamp container, on the gas discharge tube. The lamp container also has an attachment/detachment structure for enabling attachment and detachment of the portion of the outer shell on which the gas discharge tube is fixed via the insulating member, with respect to the remaining portion of the outer shell, and whereby the attachment/detachment structure facilitates gas discharge tube maintenance work.

5 Claims, 31 Drawing Sheets

U.S. PATENT DOCUMENTS

2002/0060909 A1* 5/2002 Sei et al. ..... 362/236

FOREIGN PATENT DOCUMENTS

| | | |
|---|---|---|
| JP | 59-93086 | 6/1984 |
| JP | 4-98777 | 3/1992 |
| JP | 6-60019 | 8/1994 |
| JP | 11-344435 | 12/1999 |
| JP | 2000-315417 | 11/2000 |
| JP | 2001-176304 | 6/2001 |
| JP | 2001-256924 | 9/2001 |
| WO | 00/14770 | 3/2000 |
| WO | 01/06173 | 1/2001 |
| WO | 01/91160 | 11/2001 |

* cited by examiner

LIGHT SOURCE DEVICE

TECHNICAL FIELD

The present invention relates to a light source apparatus having a gas discharge tube that emits light of a predetermined wavelength and enabling use as a light source of an analyzing apparatus, a semiconductor inspection apparatus, and the like.

BACKGROUND ART

In the field of art of analyzing apparatuses, semiconductor inspection apparatuses, etc., conventional light source apparatuses, such as described in Patent Documents 1 and 2, are known. Each of the light source apparatuses described in Patent Documents 1 and 2 has a lamp container, housing a deuterium lamp (gas discharge tube) that emits ultraviolet light, and the lamp container is housed in a housing of the light source apparatus. For example, with the light source apparatus described in Patent Document 1, a lamp box (lamp container) is fixed to a housing via a heat insulating member. Transfer of heat from the housing to the lamp box is thereby prevented to achieve stabilization of the emission brightness. Also with an analyzing apparatus (light source apparatus) of Patent Document 2, a heat insulating member is disposed between a lamp container and a housing to prevent heat generated by a gas discharge tube from imposing adverse effects on measurements.

Patent Document 1: Japanese Patent Application Laid-Open No. 2000-315417

Patent Document 2: Japanese Patent Application Laid-Open No. Hei 11-344435

DISCLOSURE OF THE INVENTION

Problems that the Invention is to Solve

The present inventors have examined conventional light source apparatuses, and as a result, have discovered the following problems. That is, a gas discharge tube that is housed inside a lamp container is readily affected by temperature change. In particular, with the light source apparatus described in Patent Document 1, because a stem of the gas discharge tube is exposed outside the lamp container, the gas discharge tube receives the influence of temperature change outside the lamp container and consequently, there was the possibility of the brightness becoming unstable.

Also, light source apparatuses are being demanded to be made compact recently, and in such a case, the lamp container and other parts are disposed close to each other inside a housing. Meanwhile, such size reduction of the apparatus makes exchange of the gas discharge tube and other maintenance work difficult.

The present invention has been developed to eliminate the problems described above. It is an object of the present invention to provide a light source apparatus with a structure that enables the brightness of a gas discharge tube to be stabilized and facilitates gas discharge tube maintenance work.

Means for Solving the Problems

A light source apparatus according to the present invention comprises a gas discharge tube generating light with a predetermined wavelength, a lamp container housing the gas discharge tube, and a base having a surface on which the lamp container is fixed. The lamp container includes a lamp fixing portion, a light emitting portion, a heat-insulating member, and a first attachment/detachment structure. The lamp fixing portion constitutes a portion of an outer shell of the lamp container. The light emitting portion allows light from the gas discharge tube housed therein to pass through to the exterior of the lamp container. The heat insulating member is housed inside the lamp container, together with the gas discharge tube. The heat insulating member is disposed between the gas discharge tube and the lamp fixing portion so that the gas discharge tube is fixed to a predetermined position of an inner side surface of the lamp fixing portion. The first attachment/detachment structure enables the lamp fixing portion (to which the gas discharge tube is fixed via the heat insulating portion) to be attached and detached, while the gas discharge tube being fixed thereto, with respect to a remaining portion that constitutes the outer shell of the lamp container together with the lamp fixing portion.

As described above, the light source apparatus according to the present invention has a structure with which the gas discharge tube is fixed inside the lamp container, and the heat insulating member is disposed between the gas discharge tube and the lamp fixing portion that constitutes the lamp container. By this structure, heat transfer between the lamp container and the gas discharge tube is reduced in comparison to the conventional light source apparatus, in which the heat insulating member is disposed outside the lamp container and the gas discharge tube and the lamp container are in contact. Consequently with the present light source apparatus, the influence of temperature change, outside the lamp container, on the gas discharge tube is reduced effectively. Also, by the first attachment/detachment structure, the lamp fixing portion can be attached and detached, while the gas discharge tube being fixed thereto, with respect to the remaining portion that constitutes a portion of the outer shell of the lamp container. In this case, when the lamp fixing portion is removed from the remaining portion of the lamp container, the gas discharge tube that is fixed to the lamp fixing portion is separated from the remaining portion as well. As a result, the interfering parts in the surroundings are eliminated so that attachment and detachment of the gas discharge tube with respect to the lamp fixing portion can be performed easily and gas discharge tube maintenance work is facilitated.

Here, as a preferable arrangement in terms of performing the maintenance work, the lamp container specifically has a box-like structure. Specifically, the box-like shape of the lamp container is defined by a lamp container base plate, fixed to the base, a lamp fixing plate, a first wall surface plate, and a second wall surface plate. The lamp fixing plate extends in a direction substantially orthogonal to the lamp container base plate and the gas discharge tube is fixed thereto via the heat insulating member. The first wall surface plate is disposed so as to oppose the lamp fixing plate across the gas discharge tube. The second wall surface plate is disposed so as to oppose the lamp container base plate across the gas discharge tube. In this case, the lamp fixing portion is constituted of the lamp fixing plate and the second wall surface plate. The first attachment/detachment structure enables the lamp fixing portion, while the gas discharge tube being fixed via the heat insulating member, to be attached and detached in the direction substantially orthogonal to the lamp container base plate, with respect to the lamp container base plate and the first wall surface plate.

Also, with the light source apparatus according to the present invention, the lamp container may furthermore have third wall surface plates that oppose each other and a second attachment/detachment structure. In this case, the pair of third wall surface plates are disposed so as to be substantially orthogonal to the second wall surface plate and the lamp fixing plate while opposing each other across the gas discharge tube. The second attachment/detachment structure enables the pair of third wall surface plates to be attached and detached with respect to the second wall surface plate and the lamp fixing plate.

With the above-described structure, gas discharge tube exchange work and other maintenance work can be performed even more easily when the lamp fixing plate is removed with the gas discharge tube being attached. When a head-on type gas discharge tube is fixed to the lamp fixing plate, the light emitting portion may be provided in the first wall surface plate. When a side-on type gas discharge tube is fixed to the lamp fixing plate, the light emitting portion may be provided in a third wall surface plate.

The light source apparatus according to the present invention may furthermore have a lens that transmits light from the gas discharge tube. In this case, the lens may be held by the light emitting portion disposed in the lamp container. By this arrangement, the positioning of the gas discharge tube with respect to the lens is facilitated.

With the light source apparatus according to the present invention, the heat insulating member may have a plate-like shape. In this case, the heat insulating member can be fixed in close contact with the lamp fixing plate readily.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will be apparent to those skilled in the art from this detailed description.

EFFECTS OF THE INVENTION

In the light source apparatus according to the present invention, because the influence of temperature change, outside the lamp container, on the gas discharge tube is reduced, stabilization of the brightness of the gas discharge tube can be realized. Also, because the lamp container has the structure with which the gas discharge tube can be attached and detached together with the lamp fixing portion, surrounding members do not interfere during exchange of the gas discharge tube and consequently, gas discharge tube maintenance work can be performed readily.

DESCRIPTION OF THE REFERENCE NUMERALS

1, 41, 56, 66, 76 . . . light source apparatus;
7 . . . base;
10 . . . deuterium lamp (gas discharge tube);
20, 40, 50, 60, 70 . . . lamp box (lamp container);
21, 51 . . . bottom plate (lamp container base plate);
22 . . . lamp fixing plate (lamp fixing portion);
23, 43, 53, 63 . . . light emitting plate (first wall surface plate);
23*a* . . . light emitting portion;
24, 54, 64, 74 . . . side surface plate (third wall surface plate);
25 . . . top plate (second wall surface plate);
26 . . . lens;
30, 80, 90, 100, 110, 120, 130, 140 . . . heat insulating socket member (heat insulating member); and
67 . . . base (lamp container base plate).

BEST MODES FOR CARRYING OUT THE INVENTION

Figure 1:
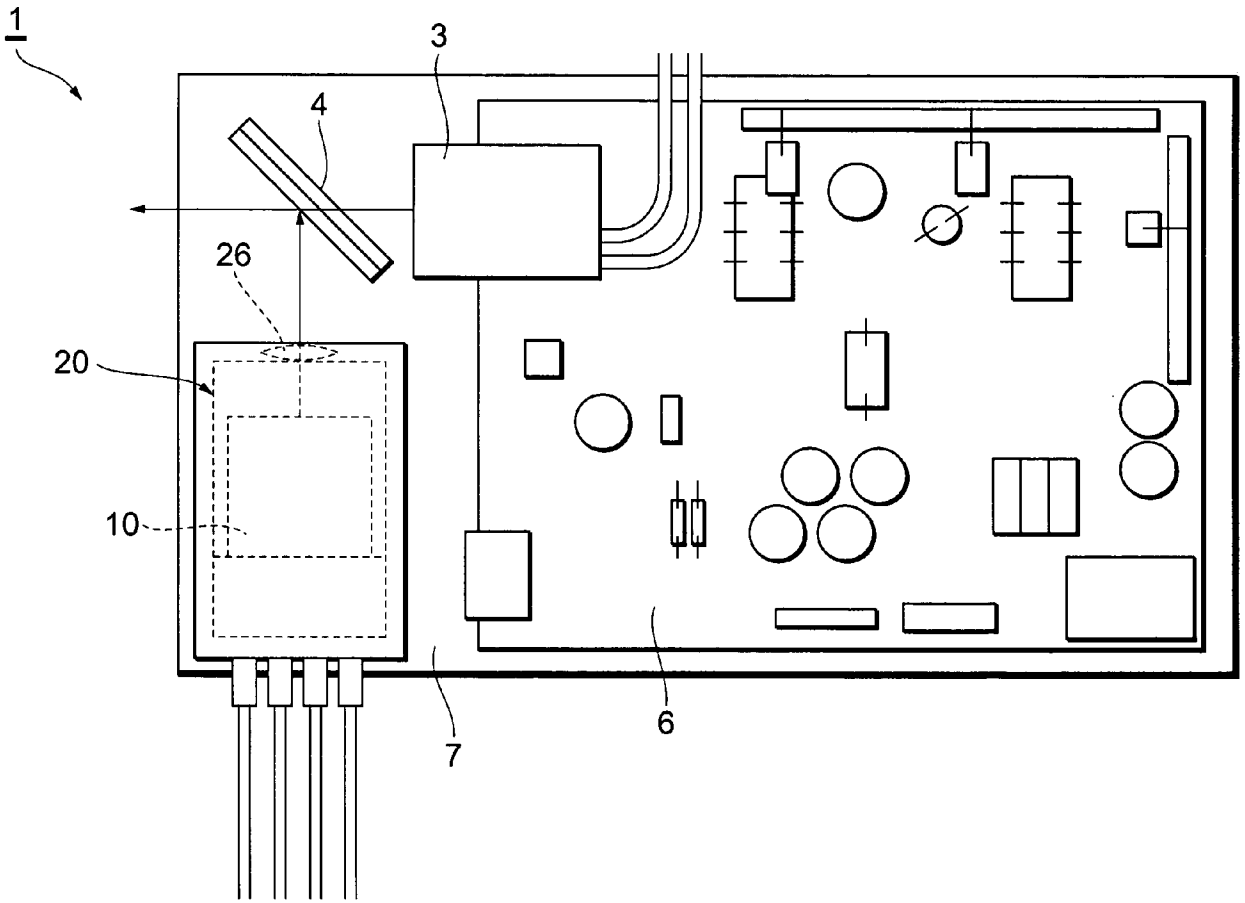
FIG. 1 is a diagram of a general arrangement of a first embodiment of a light source apparatus according to the present invention.
Figure 2:
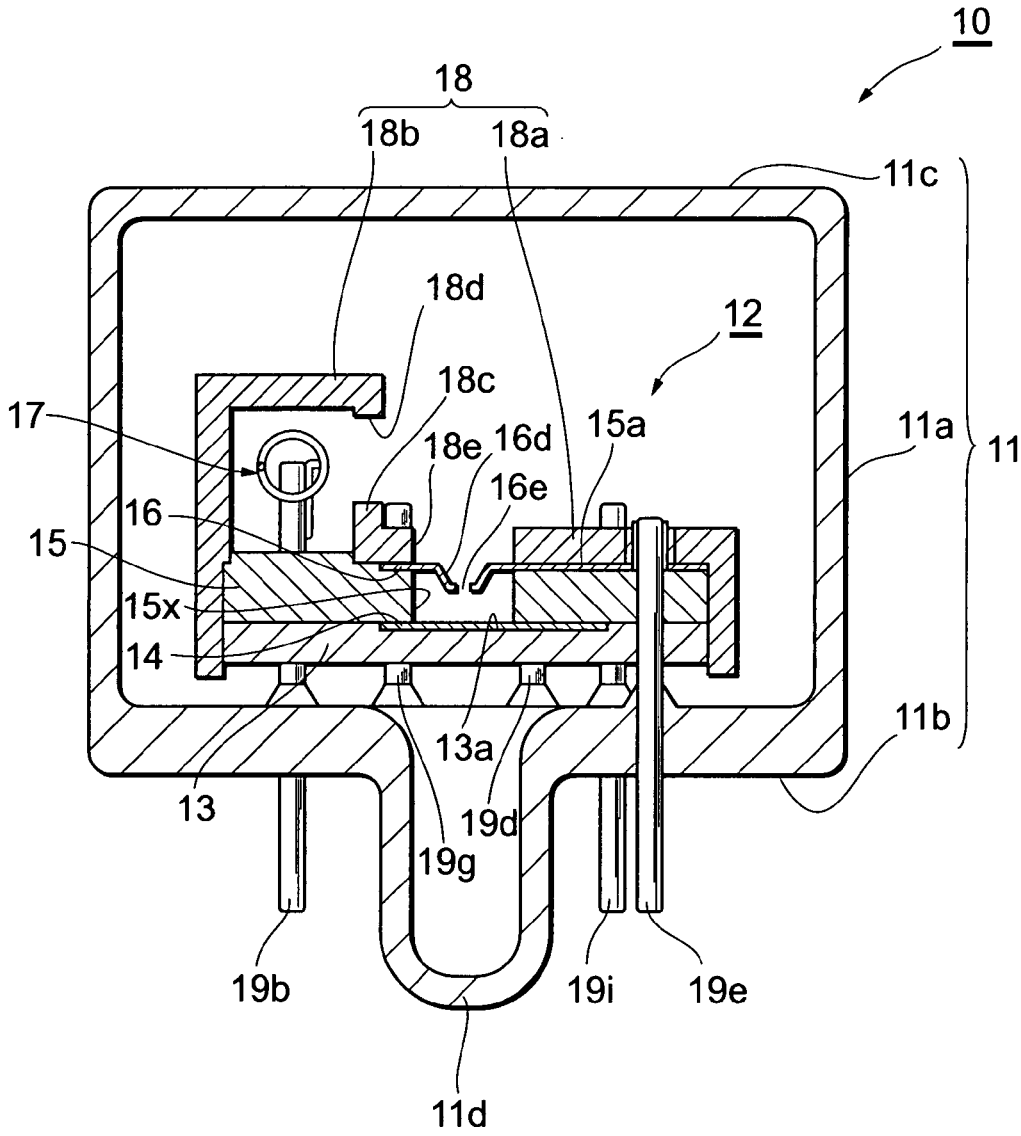
FIG. 2 is a sectional view of an internal structure of a deuterium lamp shown in FIG. 1.
Figure 3:
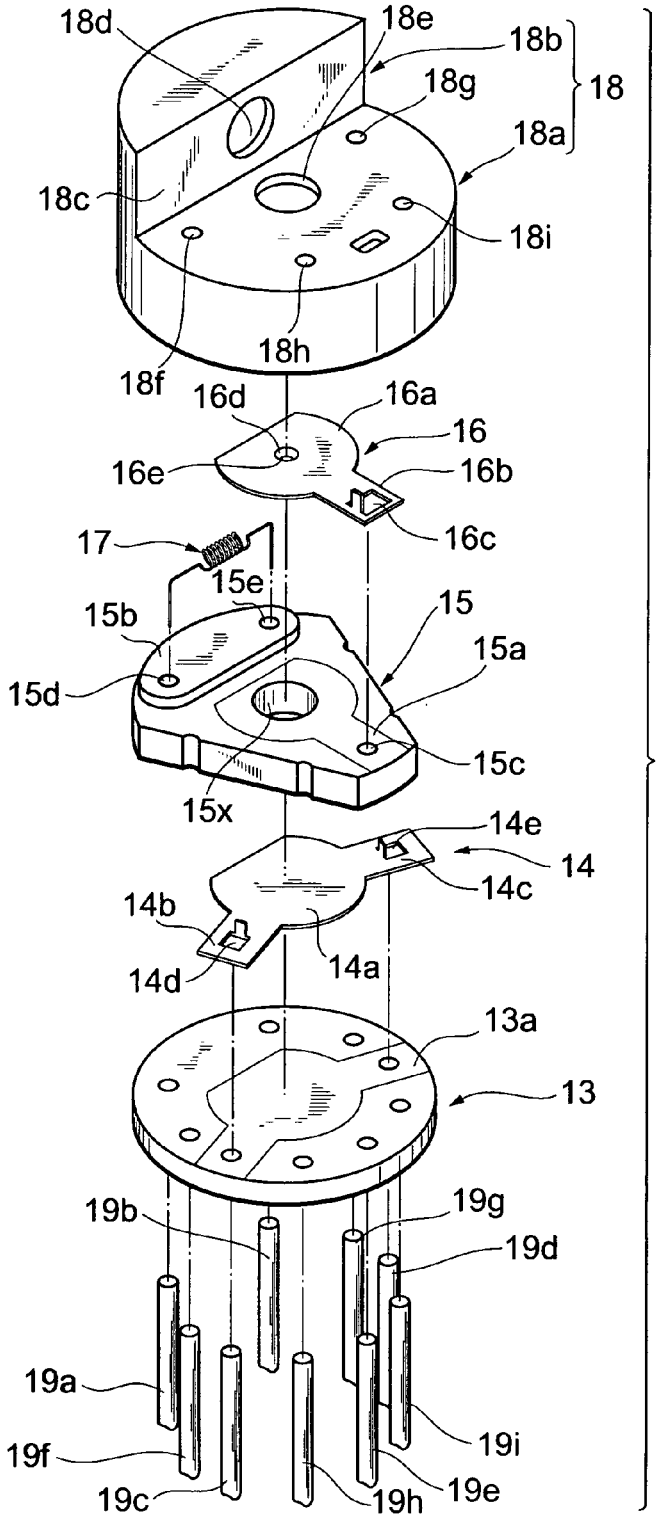
FIG. 3 is an exploded perspective view of a light emitting assembly of the deuterium lamp shown in FIG. 2.
Figure 4:
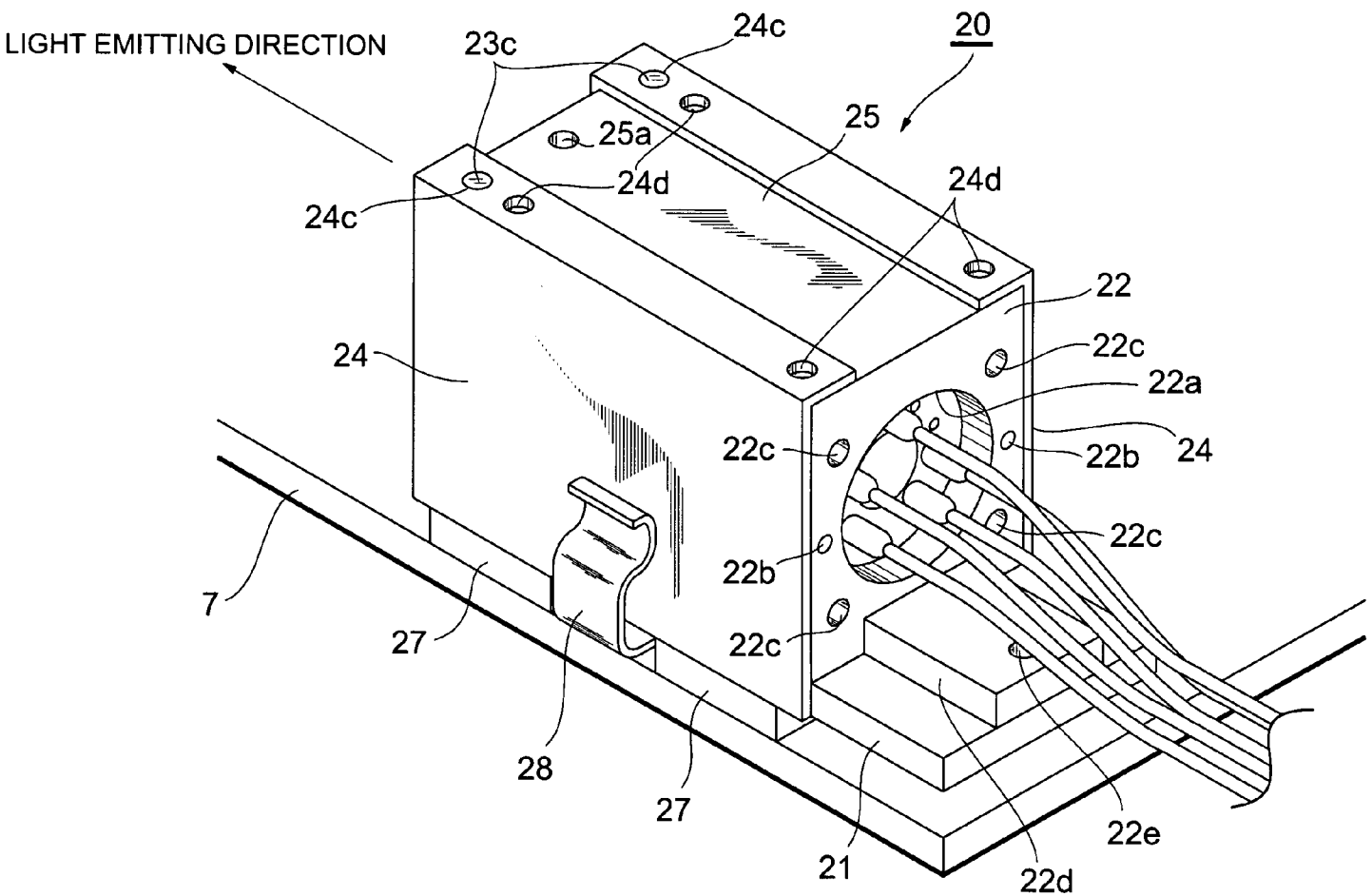
FIG. 4 is a perspective view of a structure of a lamp box shown in FIG. 1.
Figure 5:
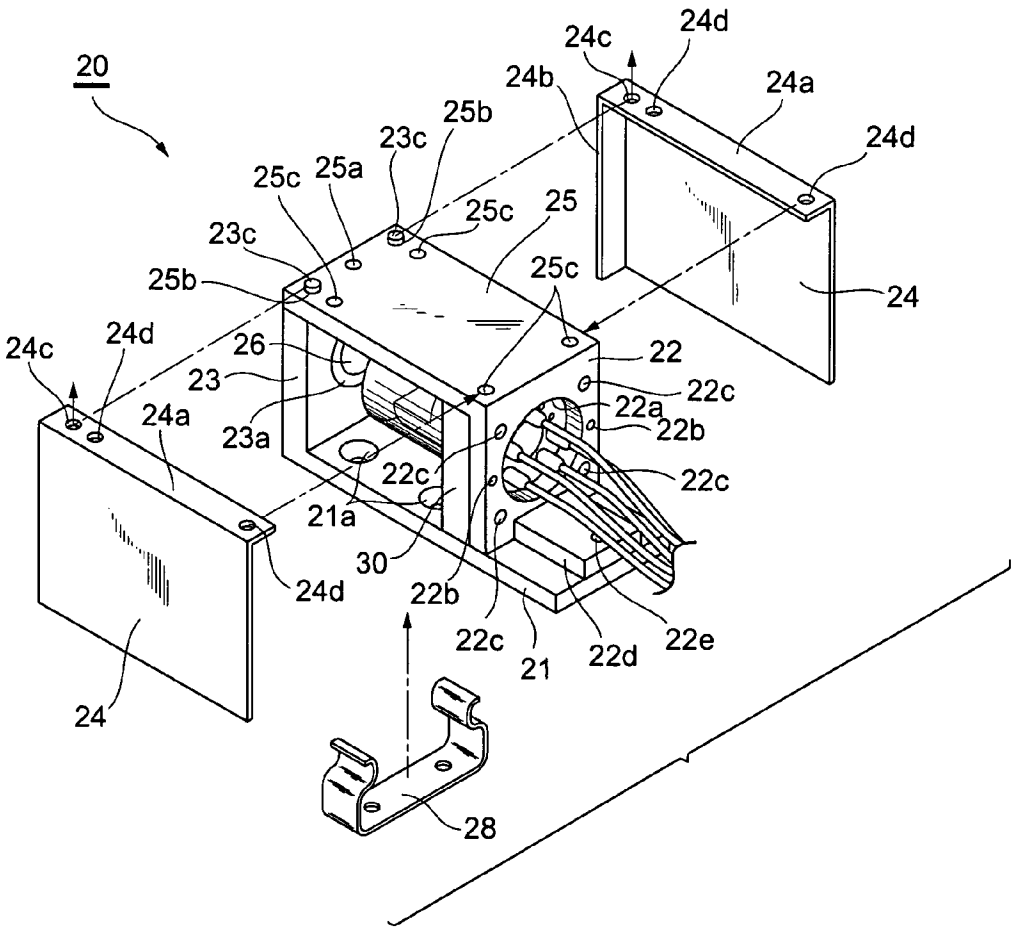
FIG. 5 is an exploded perspective view of an internal state of the lamp box (internal state in which the deuterium lamp is housed) of FIG. 4.
Figure 6:
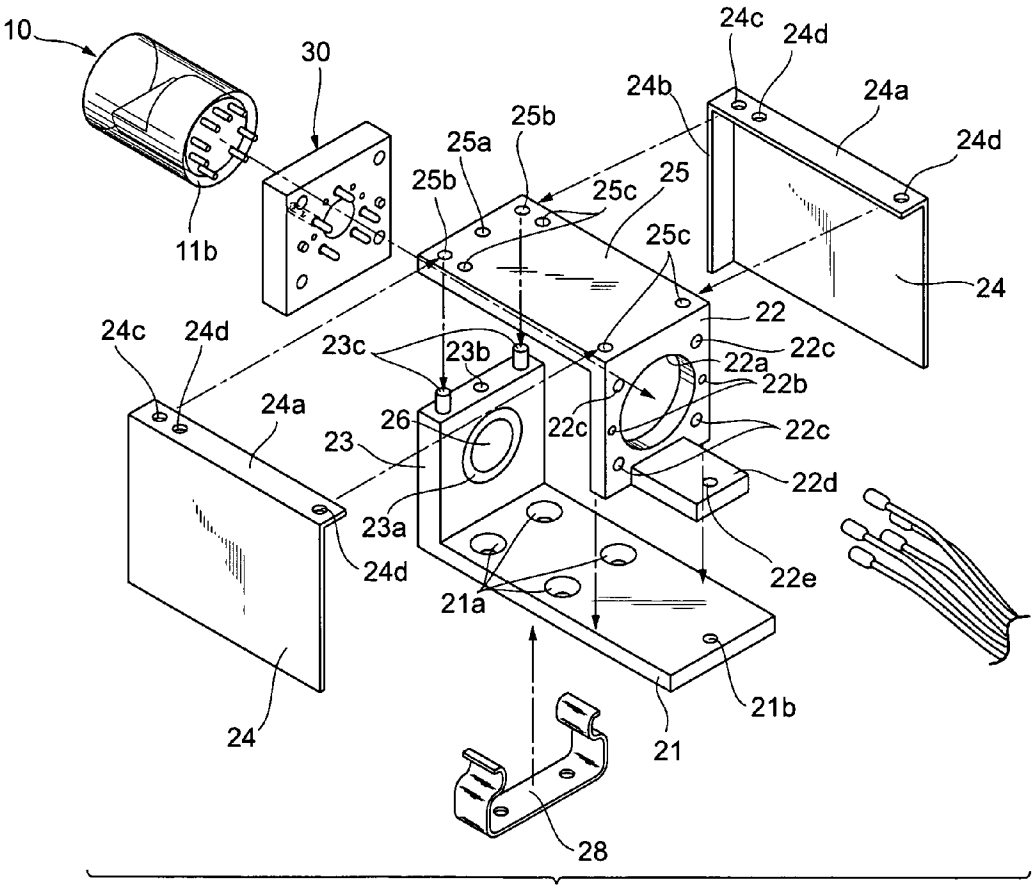
FIG. 6 is an exploded perspective view of details of the internal state of the lamp box of FIG. 4.
Figure 7:
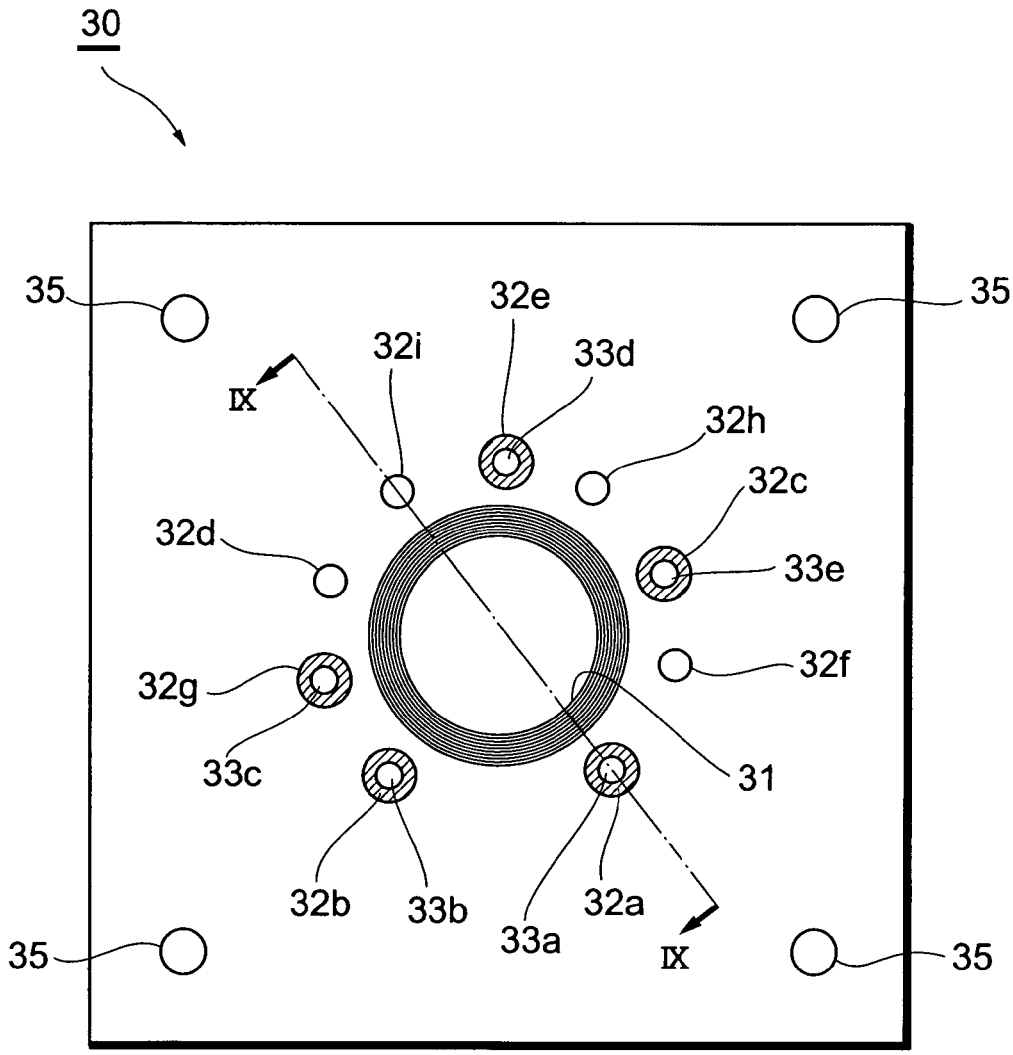
FIG. 7 is a front view of a structure of a heat insulating socket member shown in FIG. 6.
Figure 8:
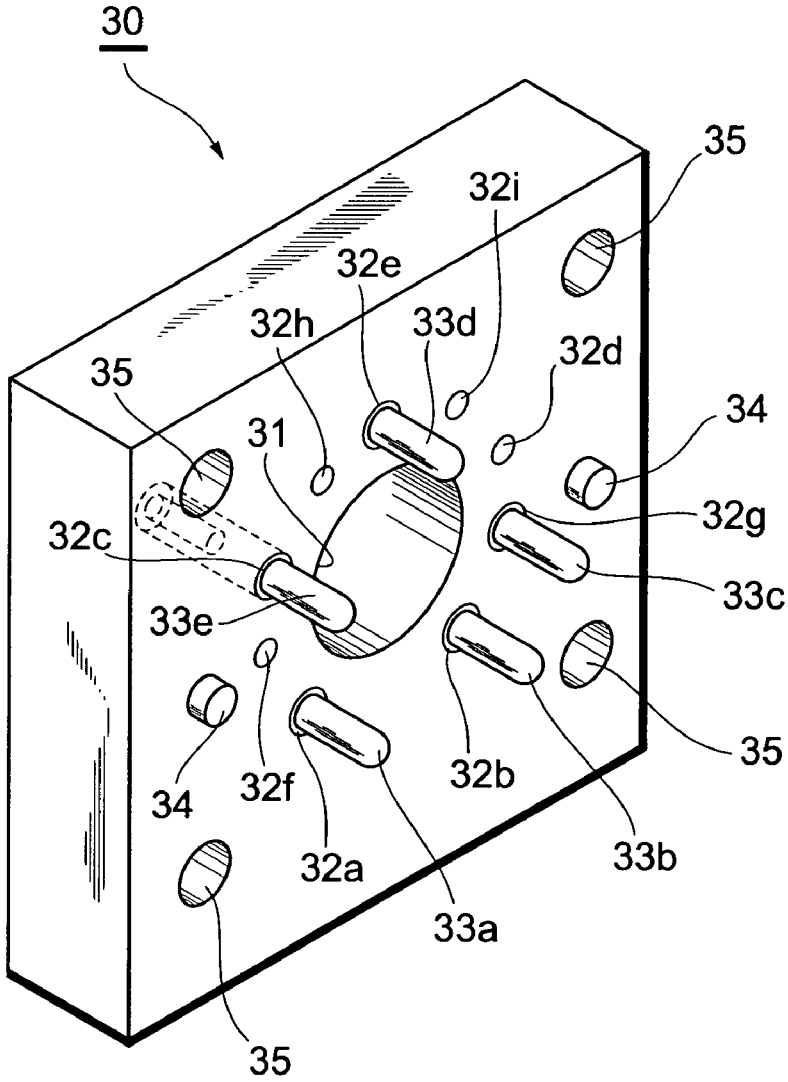
FIG. 8 is a perspective view of the structure of the heat insulating socket member, shown in FIG. 6, as viewed from a back side.
Figure 9:
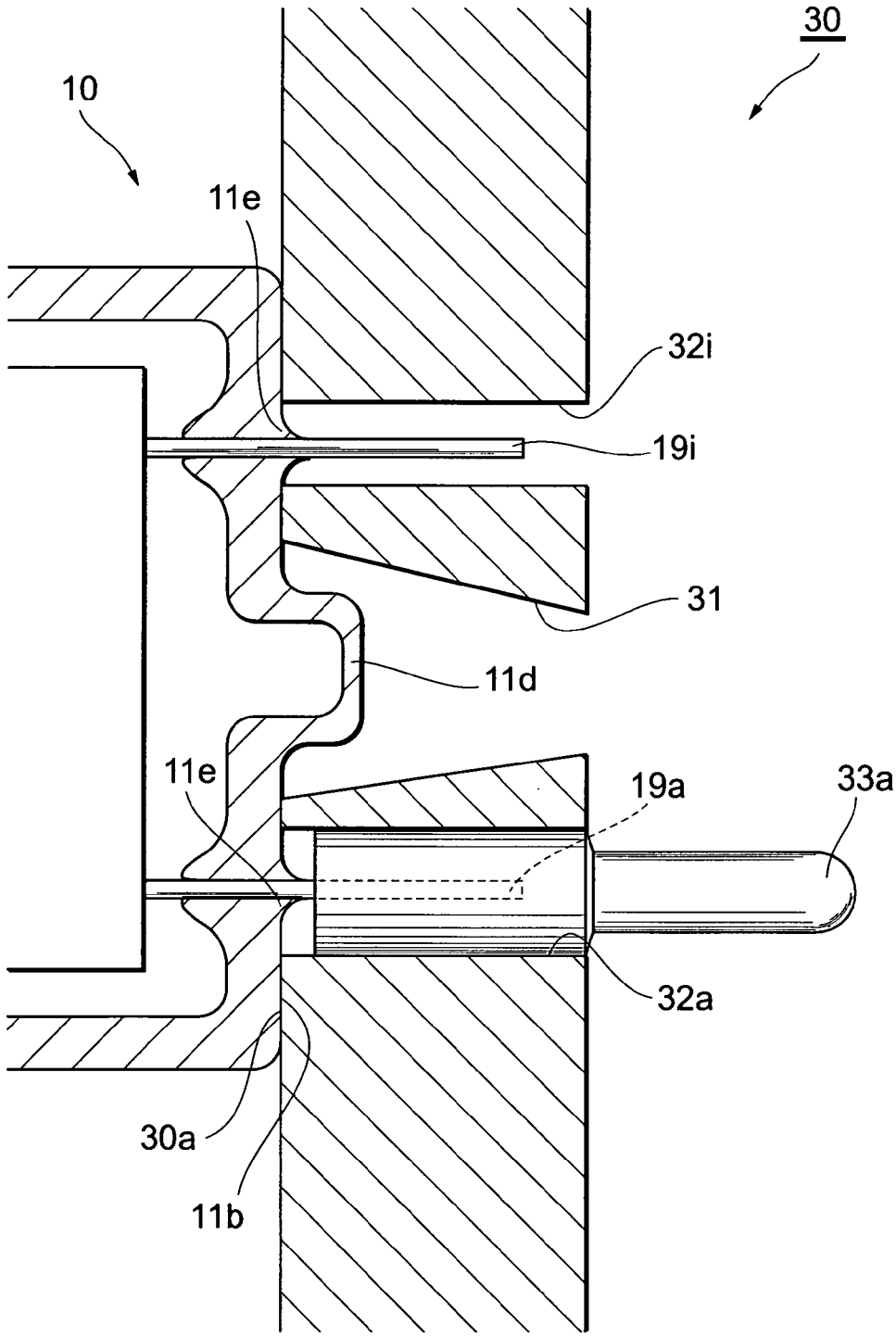
FIG. 9 is a diagram of a sectional structure along line IX-IX of the heat insulating socket (FIG. 7) in the state in which the deuterium lamp is fixed.
Figure 10:
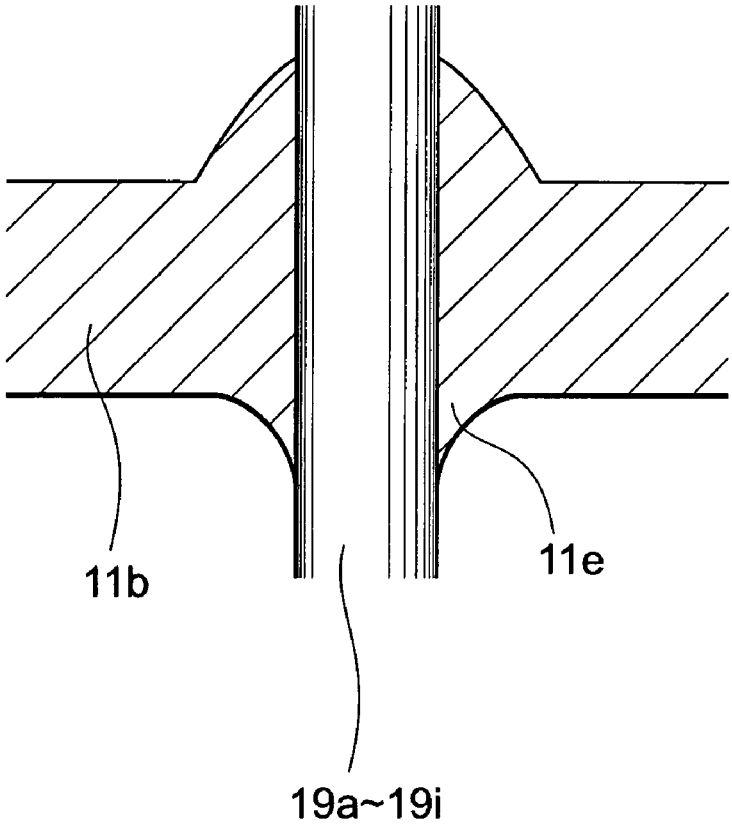
FIG. 10 is an enlarged sectional view of a stem pin penetration portion of the deuterium lamp of FIG. 9.

In the following, embodiments of a light source apparatus according to the present invention will be explained in detail using FIGS. 1 to 31. In the description of the drawings, identical or corresponding components are designated by the same reference numerals, and overlapping description is omitted. FIG. 1 is a diagram of a general arrangement of a first embodiment of a light source apparatus according to the present invention, FIG. 2 is a sectional view of a structure of a deuterium lamp shown in FIG. 1, FIG. 3 is an exploded perspective view of a light emitting assembly shown in FIG. 2, FIGS. 4 to 6 are diagrams of a structure of a lamp box shown in FIG. 1, FIGS. 7 and 8 are diagrams of a structure of a heat insulating socket member shown in FIG. 6, FIG. 9 is a diagram of a sectional structure along line IX-IX of the heat insulating socket (FIG. 7) in the state in which the deuterium lamp is fixed, and FIG. 10 is an enlarged sectional view of a stem pin penetration portion of the deuterium lamp of FIG. 9.

The light source apparatus 1, shown in FIG. 1, is used, for example, as a light source of an analyzing apparatus, etc., and has the deuterium lamp (gas discharge tube) 10 that emits ultraviolet light of a predetermined wavelength. The ultraviolet light, which is emitted from the deuterium lamp 10 and collimated by a lens 26, and an emitted light from a halogen lamp 3 are synthesized by a beam splitter 4 and the synthesized light is emitted from the light emitting apparatus 1. By this arrangement, saturation of a detector of the analyzing apparatus is prevented and effective use is made of the dynamic range of the detector.

The light source apparatus 1 furthermore has the lamp box (lamp container) 20, housing the deuterium lamp 10, and a lamp drive circuit board 6, in turn having a lamp drive circuit. The lamp box 20, the beam splitter 4, the halogen lamp 3, and the lamp drive circuit board 6 are fixed at predetermined positions of the base 7 to make the light source apparatus 1 compact.

The deuterium lamp 10 shall now be described in detail. The deuterium lamp 10 is a so-called head-on type deuterium lamp and, as shown in FIG. 2, has a sealed container 11, made of glass, and a light emitting assembly 12, housed in the sealed container 11.

The sealed container 11 has a cylindrical side tube portion 11*a*, a stem portion 11*b*, sealing a lower end of the side tube portion 11*a*, and a light emitting window 11*c*, sealing an upper end of the side tube portion 11*a*. Deuterium gas of approximately several hundred Pa is sealed inside the sealed container 11. A plurality (nine in the present embodiment) of conductive stem pins 19*a* to 19*i* (see FIG. 3) are respectively inserted through and sealed and fixed along a predetermined circumference to the stem portion 11*b*. An evacuation tube portion 11*d*, which protrudes outward (downward in the FIGURE), is formed at a center of the stem portion 11*b*.

The light emitting assembly 12 that is housed inside the sealed container 11 functions as a light source that emits ultraviolet rays. As shown in FIGS. 2 and 3, the light emitting assembly 12 has a base portion 13, an anode portion 14, a discharge path restricting portion fixing plate 15, a discharge path restricting portion 16, and a cathode portion 17, which are positioned in that order from the lower side, and a cathode portion cover 18 that covers these components.

As shown in FIG. 3, the base portion 13 is comprised of electrically insulating ceramic and has a disk shape. A plurality of openings are formed along a circumferential edge of the base portion 13, and the stem pins 19*a* to 19*i* are respectively passed through these openings. A shallow, recessed portion 13*a*, the shape of which corresponds to the shape of the anode portion 14, is formed on an upper surface of the base portion 13 to house and position the anode portion 14.

The anode portion 14 is a thin, conductive plate and has a substantially disk-like main body portion 14*a* and a pair of extending portions 14*b* and 14*c* that extend horizontally in radial directions from two locations of the circumferential edge of the main body portion 14*a*. As shown in FIG. 2, the anode 14 is housed in the recessed portion 13*a* of the base portion 13 with its upper surface being matched to the upper surface of the base portion 13. As shown in FIG. 3, openings 14*d* and 14*e* are provided in the extending portions 14*b* and 14*c* of the anode portion 14, and front ends of the stem pins 19*c* and 19*d* are electrically connected to these openings 14*d* and 14*e*.

The discharge path restricting portion fixing plate 15 is comprised of ceramic and has a substantially fan-like shape. This discharge path restricting portion fixing plate 15 is set so as to overlap with substantially central portions of the base portions 13 and the anode portion 14. At substantially the center of the discharge path restricting portion fixing plate 15, an opening 15*x* that exposes the main body portion 14*a* of the anode portion 14 is formed so as to allow a discharge path, formed between the anode portion 14 and the cathode portion 17, to pass through. Meanwhile, on an upper surface of a narrow-width side (right side in the FIGURE) of the discharge path restricting portion fixing plate 15 that includes the opening 15*x* is formed a shallow recessed portion 15*a*, with a shape corresponding to the discharge path restricting portion 16, for housing and positioning the discharge path restricting portion 16. On an upper surface of a wide-width side (left side in the FIGURE) of the discharge path restricting portion fixing plate 15, is disposed a protruding portion 15*b* for erecting the cathode potion 17. At a narrow-width side position of the recessed portion 15*a* of the discharge path restricting portion fixing plate 15 is formed an opening 15*c*, and the stem pin 19*e* is passed through this opening 15*c*. A pair of openings 15*d* and 15*e* are formed in the protruding portion 15*b* of the discharge path restricting portion fixing plate 15, and the stem pins 19*a* and 19*b* are respectively passed through these openings 15*d* and 15*e*.

The discharge path restricting portion 16 is a thin, conductive plate and has a substantially disk-like main body portion 16*a* and an extending portion 16*b* that extends horizontally in a radial direction from a circumferential edge of the main body portion 16*a*. As shown in FIG. 2, the discharge path restricting portion 16 is housed in the recessed portion 15*a* of the discharge path restricting portion fixing plate 15 with its upper surface being matched with the upper surface of the discharge path restricting portion fixing plate 15. As shown in FIG. 3, an opening 16*c* is formed in the extending portion 16*b* of the discharge path restricting portion 16, and a front end of the stem pin 19*e* is electrically connected to this opening 16*c*.

Also as shown in FIGS. 2 and 3, with the discharge path restricting portion 16, a recessed portion 16*d*, for forming an arc ball, is formed at a position that is coaxial to the opening 15*x* of the discharge path restricting portion fixing plate 15. In order to take out light efficiently, the recessed portion 16*d* functions to contain the arc ball, formed by discharge, and has a cup shape that widens toward the light emitting window 11*c*. A small-diameter, discharge path constricting opening 16*e* with a diameter of approximately 0.5 mm is formed in a bottom surface of the recessed portion 16*d* of the discharge path restricting portion 16. An arc ball of flat, ball-like shape can thereby be formed inside the recessed portion 16*d*.

The cathode portion 17 has a coil (filament coil) as a heater, and a thermal electron emitting substance, such as barium oxide, is coated on this heater. As shown in FIG. 3, with such a cathode portion 17, respective ends of the coil are erected upon being passed through the openings 15*d* and 15*e* of the protruding portion 15*b* of the discharge path restricting portion fixing plate 15 and are electrically connected to the stem pins 19*a* and 19*b* that are passed through the openings 15*d* and 15*e*.

As shown in FIGS. 2 and 3, the cathode portion cover 18 has a cylindrical shape. The cathode portion cover 18 has an anode side covering portion 18*a* and a cathode side covering portion 18*b*. The anode side covering portion 18*a* covers an assembly of the anode portion 14, the discharge path restricting portion 16, etc. The cathode side covering portion 18*b* is disposed so as to be in communication with the space inside the anode side covering portion 18*a* when the cathode portion 17 is covered. The cross-sectional shape of the cathode side covering portion 18*b* is that of a smaller portion that is formed when a cylinder that is coaxial to and of the same diameter as the anode side covering portion 18*a* is cut vertically along an axial line direction at a position that does not include the axial line. The anode side covering portion 18*a* and the cathode side covering portion 18*b* are comprised of integrally formed ceramic.

At the cathode side covering portion 18*b* of the cathode portion cover 18, a slit 18*d*, for emission of electrons, is formed as an opening in a slit plate portion 18*c* at the side of an axial center of the discharge path constricting opening 16*e* (electron emission side of the cathode portion 17). Meanwhile, at the anode side covering portion 18*a*, an opening 18*e*, through which the discharge path passes through, is formed at a position coaxial to the opening 15*x* of the discharge path restricting portion fixing plate 15 and the discharge path constricting opening 16*e* of the discharge path restricting portion 16. In order to achieve a high discharge efficiency, the opening 18*e* has a size such that the discharge path restricting portion 16 is not exposed more than necessary. Also as shown in FIG. 3, openings 18*f* to 18*i* are formed in the anode side covering portion 18*a*. Front ends of the remaining stem pins 19*f* to 19*i*, which are positioned at outer sides of the anode portion 14 and the discharge path restricting portion fixing plate 15 and extend upward, are connected and fixed to the openings 18*f* to 18*i*. By this arrangement, the cathode portion cover 18 is fixed to the front ends of the stem pins 19*a* to 19*i*, and the anode portion 14, the discharge path restricting portion fixing plate 15, and the discharge path restricting portion 16 are disposed overlappingly between the cathode portion cover 18 and the base portion 13.

The lamp box 20, which houses the deuterium lamp 10 that is arranged as described above, shall now be described in detail. As shown in FIGS. 4 to 6, the lamp box 20 has a box-like shape. The lamp box 20 has at least a bottom plate (lamp container base plate) 21, fixed to the base 7, a lamp fixing plate (lamp fixing portion) 22, orthogonal to the bottom plate 21, a light emitting plate (first wall surface plate) 23, a pair of side surface plates (third wall surface plates) 24, and a top plate (second wall surface plate) 25, serving as an upper wall surface of the lamp box 20. An outer shell of the lamp box 20 is defined by the bottom plate 21, the lamp fixing plate 22, the light emitting plate 23, the side surface plates 24, and the top plate 25.

As shown in FIG. 6, the bottom plate 21 has, near its corner portions, openings 21*a* for fixing the bottom plate 21 to the base 7 by screws. The light emitting plate 23 is erected at one end in the longitudinal direction of the bottom plate 21, and a female thread portion 21*b*, for fixing the lamp fixing plate 22, is formed near the other end. The bottom plate 21 is fixed by screws to the base 7 via heat insulating materials 27 as shown in FIG. 4.

As shown in FIG. 5, the lamp fixing plate 22 is a member to which the stem portion 11*b* (see FIGS. 2 and 6) of the deuterium lamp 10 is fixed via the heat insulating socket member (heat insulating member) 30 to be described later. As shown in FIGS. 4 to 6, with the lamp fixing plate 22, an opening 22*a*, for exposing a central portion of the heat insulating socket member 30, is formed at a central portion, and small holes 22*b*, 22*b* for performing positioning of the heat insulating socket member 30, are formed at both sides in the horizontal direction of the opening 22*a*. Meanwhile, near corner portions of the lamp fixing plate 22 are formed female thread portions 22*c* for fixing the heat insulating socket member 30. A plate-like extending portion 22*d* that extends outward (in the left-right direction in the FIGURE) is disposed at a lower end of the lamp fixing plate 22, and an opening 22*e*, for fixing the lamp fixing plate 22 to the bottom plate 21 by a screw, is formed in the extending portion 22*d*.

As shown in FIG. 5, the light emitting plate 23 constitutes an integral part together with the bottom plate 21 and is a wall surface that extends upward from one end of the bottom plate 21 so as to oppose the lamp fixing plate 22 across the deuterium lamp 10. As shown in FIGS. 5 and 6, a light emitting portion 23*a* that allows emitted light from the deuterium lamp 10 to be emitted out of the lamp box 20 is formed at a central portion of the light emitting plate 23, and a lens 26 is held in the light emitting portion 23*a*. As shown in FIG. 6, at a center of an upper end surface of the light emitting plate 23 is disposed a female thread portion 23*b* for fixing the top plate 25 by a screw, and at both sides of the female thread portion 23*b* are erected positioning pins 23*c*,23*c* for the positioning of the top plate 25.

As shown in FIG. 5, the top plate 25 constitutes an integral part together with the lamp fixing plate 22 and is a wall surface that extends horizontally from an upper end of the lamp fixing plate 22 to an upper end of the light emitting plate 23 so as to oppose the bottom plate 21 across the deuterium lamp 10. As shown in FIG. 6, with the top plate 25, an opening

25*a* and positioning holes 25*b* are disposed at positions respectively corresponding to the female thread portion 23*b* and the positioning pins 23*c* of the light emitting plate 23. A male screw is screwed into the female thread portion 23*b* via the opening 25*a* with the positioning pins 23*c* being inserted through the positioning holes 25*b*. The top plate 25 and the lamp fixing plate 22 are furthermore positioned and fixed by a male screw being screwed into the female thread portion 21*b* via the opening 22*e*. The lamp fixing plate 22 and the top plate 25 are thus detachably fixed to the bottom plate 21 and the light emitting plate 23. Also, a plurality of female thread portions 25*c*, for fixing upper ends of the side surface plates 24, are formed near sides of the top plate 25.

As shown in FIGS. 4 to 6, the pair of side surface plates 24 are members that constitute side walls of the lamp box 20. These side surface plates 24 are positioned opposite each other across the deuterium lamp 10 as shown in FIG. 5. An upper end of each side surface plate 24 is bent and this bent portion constitutes an upper end plate 24*a* that faces an upper surface of the top plate 25. An end at the light emitting plate 23 side of each side surface plate 24 is also bent and this bent portion constitutes a front end plate 24*b* that faces a front surface of the light emitting plate 23. Openings 24*c* and 24*d* and 24*d* that respectively correspond to the positioning pin 23*c* of the light emitting plate 23 and the female thread portions 25*c*,25*c* of the top plate 25 are formed in the upper end plate 24*a* of each side surface plate 24. By inserting the positioning pin 23*c* through the opening 24*c* and screwing male screws into the female thread portions 25*c* via the openings 24*d* with the upper end plate 24*a* being overlapped onto the top plate 25, each side surface plate 24 is fixed to the top plate 25. These side surface plates 24 are urged inward by a plate spring 28, formed by bending a thin plate and extending to outer surfaces of these side surface plates from a lower side of the bottom plate 21. That is, the pair of side surface plates 24 are detachably attached with respect to the bottom plate 21, lamp fixing plate 22, the light emitting plate 23, and the top plate 25.

The heat insulating socket member 30 for fixing the deuterium lamp 10 to the lamp box 20 shall now be described in detail. As shown in FIGS. 5 and 6, the heat insulating socket member 30 has a plate shape and is a member that fixes the deuterium lamp 10 to the lamp fixing plate 22 while holding the stem portion 11*b* side of the deuterium lamp 10 as mentioned above. In regard to portions of the heat insulating socket member 30, a side at which the deuterium lamp 10 is held shall be referred to as a "front side" and a side that is fixed to the lamp fixing plate 22 shall be referred to as a "back side" in the description that follows.

The heat insulating socket member 30 is comprised of a polyether ether ketone resin material (PEEK material: registered trademark of Victrex Corp.) that has a heat insulating property, electrical insulating property, durability against ultraviolet rays, and corrosion resistance. The heat insulating socket member 30 has predetermined flat surfaces at respectively the front side and the back side and has a size corresponding to the lamp fixing plate 22. As shown in FIGS. 7 and 8, the heat insulating socket member 30 has an evacuation tube entry portion 31, for entry of the evacuation tube portion 11*d* (see FIG. 2) of the deuterium lamp 10, stem pin entry portions 32*a* to 32*i*, for entry of the stem pins 19*a* to 19*i* (see FIG. 3) of the deuterium lamp 10, pin socket members 33*a* to 33*e*, inserted in the predetermined stem pin entry portions 32*a*, 32*b*, 32*g*, 32*e*, and 32*c* and electrically connected to the stem pins 19*a*, 19*b*, 19*g*, 19*e*, and 19*c*, positioning pins 34, protruding from the back side for positioning of the heat insulating socket 30 with respect to the lamp fixing plate 22, and openings 35 for fixing the heat insulating socket member 30 by screws.

The evacuation tube entry portion 31 is an opening that is formed in a central portion of the heat-insulating socket member 30. The diameter of this opening increases from the back side to the front side.

The stem pin entry portions 32*a* to 32*i* are a plurality of openings formed along a predetermined circumference in a periphery of the evacuation tube entry portion 31. These openings are positioned in correspondence to the stem pins 19*a* to 19*i* (see FIG. 3). The stem pin entry portions 32*a*, 32*b*, 32*g*, 32*e*, and 32*c*, into which the pin socket members 33*a* to 33*e* enter, have a diameter of approximately 1.8 mm and the remaining stem pin entry portions 32*d*, 32*i*, 32*h*, and 32*f* have a diameter of approximately 1.3 mm. As shown in FIG. 10, the stem portion 11*b* has a glass bulging portion 11*e* at a periphery of each portion through which a stem pin 19 passes. As shown in FIG. 9, in order to fix the stem portion 11*b* and the heat insulating socket member 30 in close contact, the stem pin entry portions 32*d*, 32*i*, 32*h*, and 32*f* have a diameter that allows the entry of the bulging portions 11*e*.

The pin socket members 33*a* to 33*e*, which are insertingly attached to the stem pin entry portions 32*a*, 32*b*, 32*g*, 32*e*, and 32*c*, have cylindrical shapes. As shown in FIG. 8, these pin socket members 33*a* to 33*e* protrude from the back side of the heat insulating socket member 30 and the closed rear ends thereof are connected to electrical cables. The stem pins 19*a*, 19*b*, 19*g*, 19*e*, and 19*c* are detachable with respect to the pin socket members 33*a* to 33*e*, and rear ends (right sides in the FIGURE) of the stem pins 19*a*, 19*b*, 19*g*, 19*e*, and 19*c* are fixed (electrically connected) to the pin socket members 33*a* to 33*e*. As shown in FIG. 9, the mounting positions of the front ends of the pin socket members 33*a* to 33*e* are separated by a predetermined distance from a front surface of the heat insulating socket member 30. Specifically, the pin socket members 33*a* to 33*e* are separated so as not to contact the bulging portions 11*e* of the stem portion 11*b*.

As shown in FIG. 9, the deuterium lamp 10 is detachably fixed to the heat insulating socket member 30. Specifically, the evacuation tube portion 11*d* and the stem pins 19*a* to 19*i* of the deuterium lamp 10 respectively enter the evacuation tube entry portion 31 and the stem pin entry portions 32*a* to 32*i* of the heat insulating socket member 30, the stem portion 11*b* is put in plane contact with the front surface of the heat insulating socket member 30, and the stem pins 19*a*, 19*b*, 19*g*, 19*e*, and 19*c* are fitted into the pin socket members 33*a* to 33*e*. Here, the front portion of the heat-insulating socket member 30 that is in contact with the stem portion 11*b* becomes a plane contact portion 30*a*.

As shown in FIG. 8, the positioning pins 34 protrude outward from both sides of the evacuation tube entry portion 31 and fit into small holes 22*b* (see FIG. 6) of the lamp fixing plate 22. Also as shown in FIGS. 7 and 8, the openings 35 are respectively formed at positions corresponding to the female thread portions 22*c* (see FIG. 6) of the lamp fixing plate 22. By the positioning pins 34 being fitted into small holes 22*b* of the lamp fixing plate 22 and male screws being screwed into the female thread portions 22*c* via the openings 35, the heat insulating socket member 30 is positioned and fixed to the lamp fixing plate 22. The lamp fixing plate 22 can thus be attached and detached with respect to the light emitting plate 23 and the bottom plate 21 with the deuterium lamp 10 being fixed as it is to the lamp fixing plate 22 via the heat insulating socket member 30.

Actions of the light source apparatus 1 arranged as described above shall now be described. At the deuterium lamp 10, first, an electric power of approximately 10 W is supplied from an external power supply for the cathode to the cathode portion 17 via the pin socket members 33*a* and 33*b* and the stem pins 19*a* and 19*b* in a period of approximately 20 seconds before discharge. By this supply of power, the coil that constitutes the cathode portion 17 is preheated. A voltage of approximately 160V is then applied across the cathode portion 17 and the anode portion 14 from an external main discharge power supply and via the stem pins 19*c* and 19*d*. By this voltage application, preparation for arc discharge is completed.

Thereafter, a predetermined voltage, for example, a voltage of approximately 350V is applied across the discharge path restricting portion 16 and the anode portion 14 from an external trigger power supply and via the stem pins 19*e*, 19*c*, and 19*d*. Discharge then occurs successively across the cathode portion 17 and the discharge path restricting portion 16 and across the cathode portion 17 and the anode portion 14, and a starting discharge occurs across the cathode portion 17 and the anode portion 14. When the starting discharge occurs, an arc discharge (main discharge) is maintained across the cathode portion 17 and the anode portion 14 and an arc ball is generated inside the recessed portion 16*d* of the discharge path restricting portion 16. Ultraviolet rays taken out from this arc ball are transmitted through the light emitting window 11*c* and emitted to the exterior as light of extremely high brightness. In the discharge process, sputtering products and vaporized matter issuing from the cathode portion 17 are prevented from becoming attached to the light emitting window 11*c* by the cathode side covering portion 18*b*.

The emitted light from the deuterium lamp 10 passes through the lens 26 and is emitted out of the lamp box 20. The emitted ultraviolet rays are synthesized with the emitted light from the halogen lamp 3 by the beam splitter 4.

Here, when exchange of the deuterium lamp 10 or other maintenance work becomes necessary due to long-term use, the male screws that fix the lamp fixing plate 22 and the top plate 25 are loosened once. By then moving the lamp fixing plate 22 and the top plate 25 upward, the lamp fixing plate 22 and the top plate 25 become removable from the bottom plate 21 and the light emitting plate 23. The deuterium lamp 10 is thereby removed, together with the lamp fixing plate 22, from the light source apparatus 1. Because in then removing the deuterium lamp 10 from the lamp fixing plate 22, there are no interfering members, such as the light emitting plate 23, etc., in the surroundings and the structure enables attachment and detachment of the deuterium lamp 10 with respect to the heat insulating socket member 30 to be performed readily, the exchange of the deuterium lamp 10 can be performed easily.

Also in mounting the deuterium lamp 10, the stem portion 11*b* and the heat insulating socket member 30 are fixed in close contact simply by the stem pins 19*a*, 19*b*, 19*g*, 19*e*, and 19*c* of the deuterium lamp 10 being inserted in the pin socket members 33*a* to 33*e* of the heat insulating socket member 30. By the lamp fixing plate 22, to which the deuterium lamp 10 is fixed, and the top plate 25 then being mounted to the bottom plate 21 and the light emitting plate 23, mounting of high precision in regard to distances and optical axis between the lens 26, beam splitter 4, and other optical system components and the deuterium lamp 10 is realized.

The light source apparatus 1 thus has a structure in which the deuterium lamp 10 is fixed inside the lamp box 20 and the heat insulating socket member 30 is disposed between the deuterium lamp 10 and the lamp fixing plate 22. Thus in comparison to the conventional light source apparatus, in which the heat insulating member is disposed outside the lamp box and the deuterium lamp and the lamp box are in contact, heat transfer between the lamp box 20 and the deuterium lamp 10 is reduced and the influence of temperature change, outside the lamp box 20, on the deuterium lamp 10 is reduced effectively. Stabilization of the brightness of the deuterium lamp 10 can thus be realized.

Because the lamp fixing plate 22 has a structure that enables attachment and detachment with respect to the light emitting plate 23 that opposes the lamp fixing plate 22 while the deuterium lamp 10 being fixed thereto, the deuterium lamp 10 can be removed together with the lamp fixing plate 22 and separated from the light emitting plate 23. As a result, interfering parts are eliminated from the surroundings, thus enabling the deuterium lamp 10 to be attached and detached with respect to the lamp fixing plate 22 readily and maintenance work of the deuterium lamp 10 to be performed readily. Also, because the deuterium lamp 10 has a structure that enables attachment and detachment with respect to the heat insulating socket member 30, the removal of the deuterium lamp 10 is also easy. The exchange of the deuterium lamp 10 and other maintenance work are facilitated from this aspect as well.

In the lamp box 20, the pair of side surface plates 24 have a structure that enables attachment and detachment with respect to the lamp fixing plate 22 and the top plate 25. Thus when the deuterium lamp 10 is removed with it being fixed to the lamp fixing plate 22, the exchange of the deuterium lamp 10 and other maintenance work can be performed even more readily. Each of the side surface plates 24 is fixed to the top plate 25 by inserting the positioning pin 23*c* and the male screws through the openings 24*c* and 24*d* formed in the upper end plate 24*a*. Meanwhile, the top plate 25 and the lamp fixing plate 22 are fixed to the light emitting plate 23 and the bottom plate 21 by the male screws and the positioning pins 23*c* being respectively inserted through the opening 25*a*, the positioning holes 25*b*, and the opening 22*e* that are formed on the upper surfaces of the top plate 25 and the extending portion 22*d*. The pair of side surface plates 24, the lamp fixing plate 22, and the top plate 25 can thus be attached and detached by just working from the upper side of the lamp box 20, and the exchange of the deuterium lamp 10 and other maintenance work can thus be performed even more readily. Such a structure is especially effective in cases where the installation space of the lamp box 20 is extremely narrow.

The light source apparatus 1 is provided with the pin socket members 33*a* to 33*e*, into which stem pins 19*a*, 19*b*, 19*g*, 19*e*, and 19*c* that protrude outward from the stem portion 11*b* are made to enter, and the heat insulating socket member 30, which has the pin socket members 33*a* to 33*e*. Because the heat insulating socket member 30 has a structure that detachably fixes the deuterium lamp 10 while being in plane contact with the stem portion 11*b*, the deuterium lamp 10 is fixed in close contact with the heat insulating socket member 30 and the precision of positioning of the deuterium lamp 10 can be improved. Because the stem portion 11*b* is thus fixed in close contact with the heat insulating socket member 30, the stability of fixing of the deuterium lamp 10 is improved in comparison to the conventional light source apparatus, in which fixing with respect to a base plate that fixes the deuterium lamp is achieved via stem pins (with there being a gap between the base plate and the stem portion).

The light emitting plate 23 has a structure that holds the lens 26 that transmits the light from the deuterium lamp 10. The deuterium lamp 10 can thus be positioned readily with respect to the lens 26.

The heat insulating socket member 30 has a plate shape. The heat insulating socket member 30 is thus made to be fixed in close contact to the lamp fixing plate 22 readily.

With the deuterium lamp 10 having the above-described structure, the cathode portion 17 is surrounded by the cathode side covering portion 18*b* of the cathode portion cover 18 that is comprised of ceramic of excellent heat retaining property (only the slit 18*d* for electron emission is formed as the minimum necessary opening in the cathode side covering portion 18*b*). The effect of heat retaining of the cathode portion 17 is significantly improved by the cathode side covering portion 18*b*. As a result of temperature maintenance of the cathode potion 7 thus being made simple and the consumption power being lowered, the gas discharge tube 10, including its power supply, can be made compact.

The cathode portion cover 18 is formed integrally of ceramic so that while the cathode side covering portion 18*b* covers the cathode portion 17 in a state enabling electron emission, the anode side covering portion 18*a* covers the assembly, which includes the anode portion 14 and the discharge path restricting portion 16, in a manner enabling discharge. By this structure, the need to expose the discharge path restricting portion 16 more than necessary is eliminated and consequently, a member (a separate member that corresponds to an upper portion of the anode side covering portion 18*a* in the present embodiment) for improving the discharge efficiency is made unnecessary. The number of parts is thus reduced and cost reduction is achieved.

The discharge path restricting portion 16 is fixed in a state of being sandwiched by the upper wall portion of the anode side covering portion 18*a*, which is the portion of the cathode portion cover 18 that covers the abovementioned assembly, and the discharge path restricting portion fixing plate 15, provided with the opening 15*x*, through which the discharge path passes. The discharge path restricting portion 16 can thus be fixed readily with a small number of parts, and further cost reduction is enabled.

Figure 11:
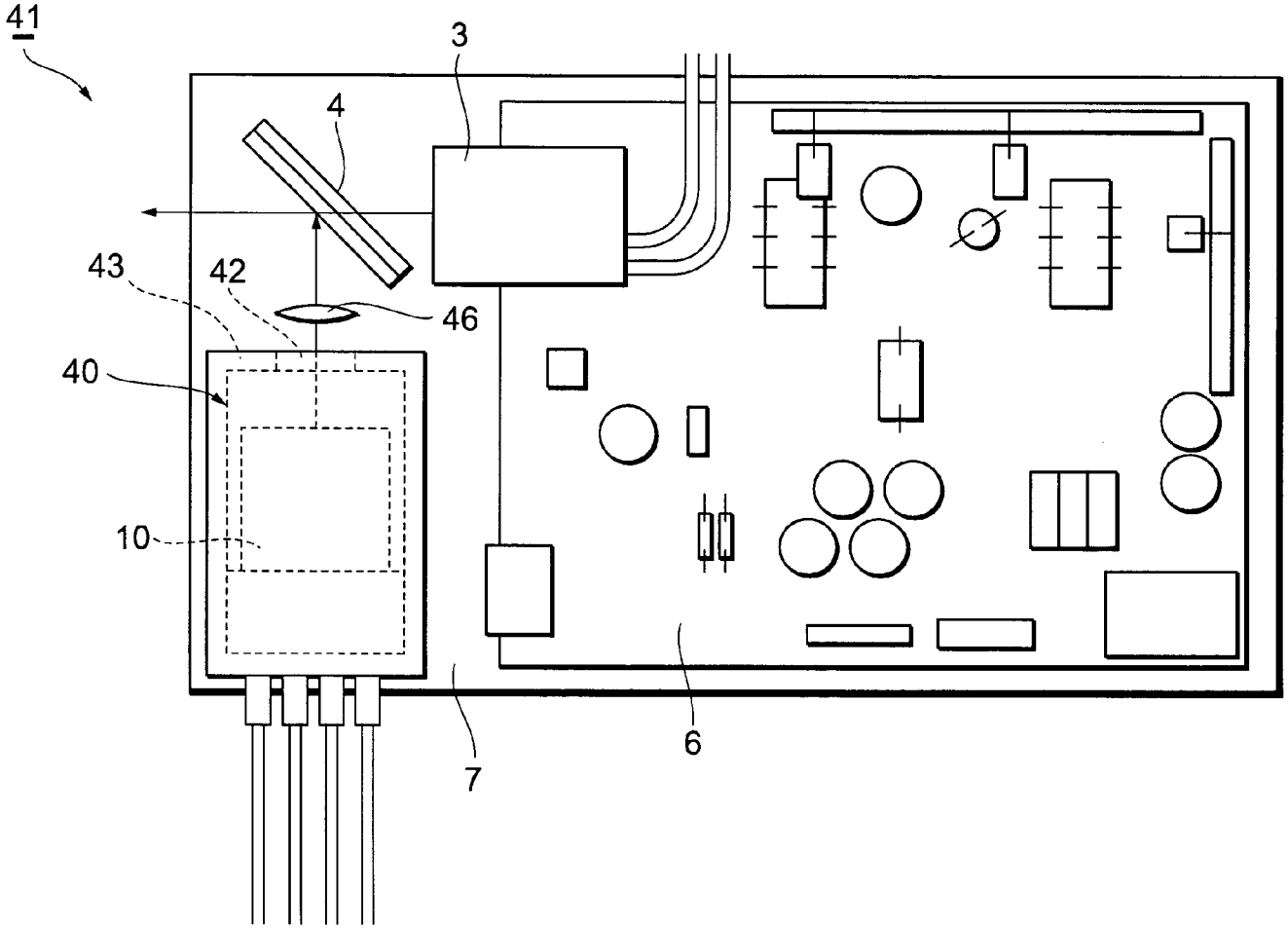
FIG. 11 is a diagram of a general arrangement of a second embodiment of a light source apparatus according to the present invention.

A second embodiment of a light source apparatus according to the present invention shall now be described with reference to FIG. 11. FIG. 11 is a diagram of a general arrangement of the second embodiment of a light source apparatus according to the present invention.

The points of difference of a light source apparatus 41 according to the second embodiment with respect to the light source apparatus 1 according to the first embodiment are that in place of the lamp box 20 that is provided with the light emitting plate 23 having the lens 26, a lamp box 40, having a light emitting plate 43 with a light emitting window 42, is provided and a lens 46 is fixed to the base 7 so that the lens 46 is positioned between the light emitting plate 43 and the beam splitter 4. The arrangement of the rest of the light source apparatus 41 according to the second embodiment is the same as that of the light source apparatus 1 according to the first embodiment, and even with this arrangement, the same actions and effects as the light source apparatus 1 according to the first embodiment are exhibited.

Figure 12:
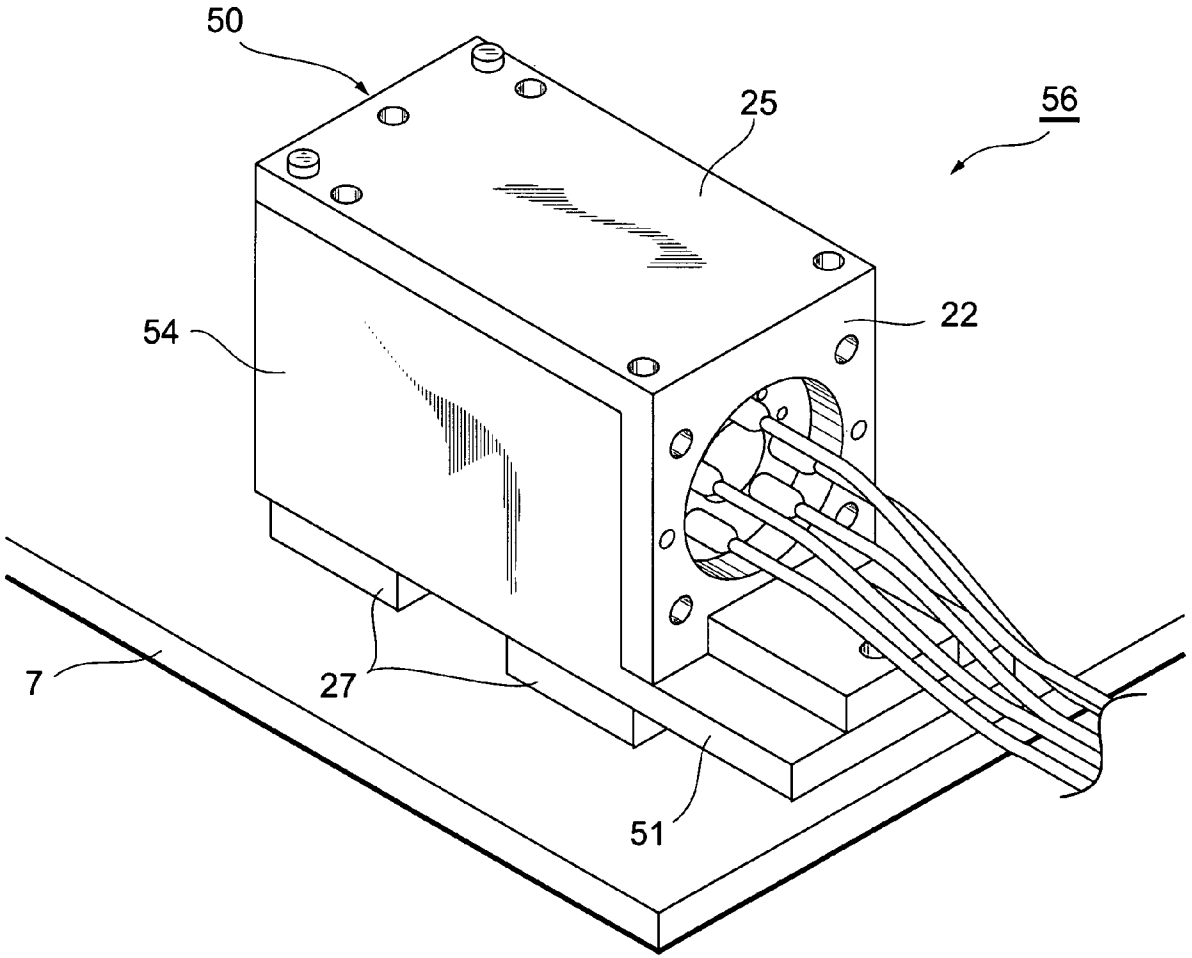
FIG. 12 is a perspective view of a structure of a lamp box of a third embodiment of a light source apparatus according to the present invention.
Figure 13:
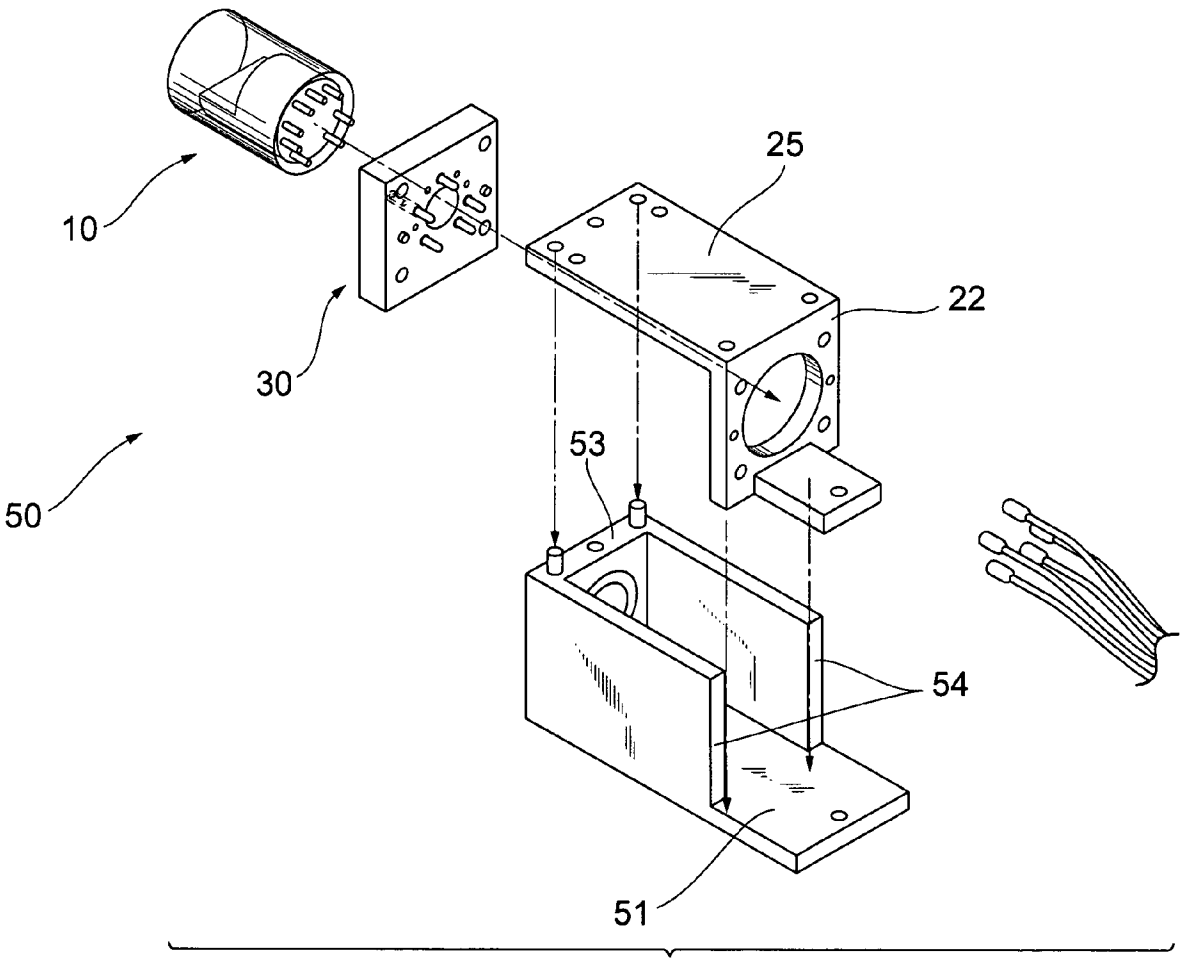
FIG. 13 is an exploded perspective view of an internal state of the lamp box (internal state in which the deuterium lamp is housed) of FIG. 12.

A third embodiment of a light source apparatus according to the present invention shall now be described with reference to FIGS. 12 and 13. FIG. 12 is a perspective view of a structure of a lamp box of the third embodiment of a light source apparatus according to the present invention. FIG. 13 is an exploded perspective view of an internal state of the lamp box (internal state in which the deuterium lamp is housed) of FIG. 12.

A point of difference of a light source apparatus 56 according to the third embodiment with respect to the light source apparatus 1 according to the first embodiment is that in place of the lamp box 20, with which the side surface plates 24, the bottom plate 21, and the light emitting plate 23 are arranged as separate members, a lamp box 50, with which side surface plates 54, a bottom plate 51, and a light emitting plate 53 constitute an integral member, is applied and the plate spring 28 that urges the side surface plates is thereby made unnecessary. Specifically, the bottom plate 51 and the light emitting plate 53 have the same structures as the bottom plate 21 and the light emitting plate 23 in the first embodiment. However, the side surface plates 54 are erected upward from ends in the width direction of the bottom plate 51. The side surface plates 54 thus form wall surfaces that are orthogonal to the bottom plate 51 and the light emitting plate 53 and extend to the same height as the light emitting plate 53. The arrangement of the rest of the light source apparatus 56 according to the third embodiment is the same as that of the light source apparatus 1 according to the first embodiment, and even with this structure, the same actions and effects as the light source apparatus 1 according to the first embodiment are exhibited. In addition, because the plate spring 28 is made unnecessary, the number of parts is reduced even more than in the first embodiment.

Figure 14:
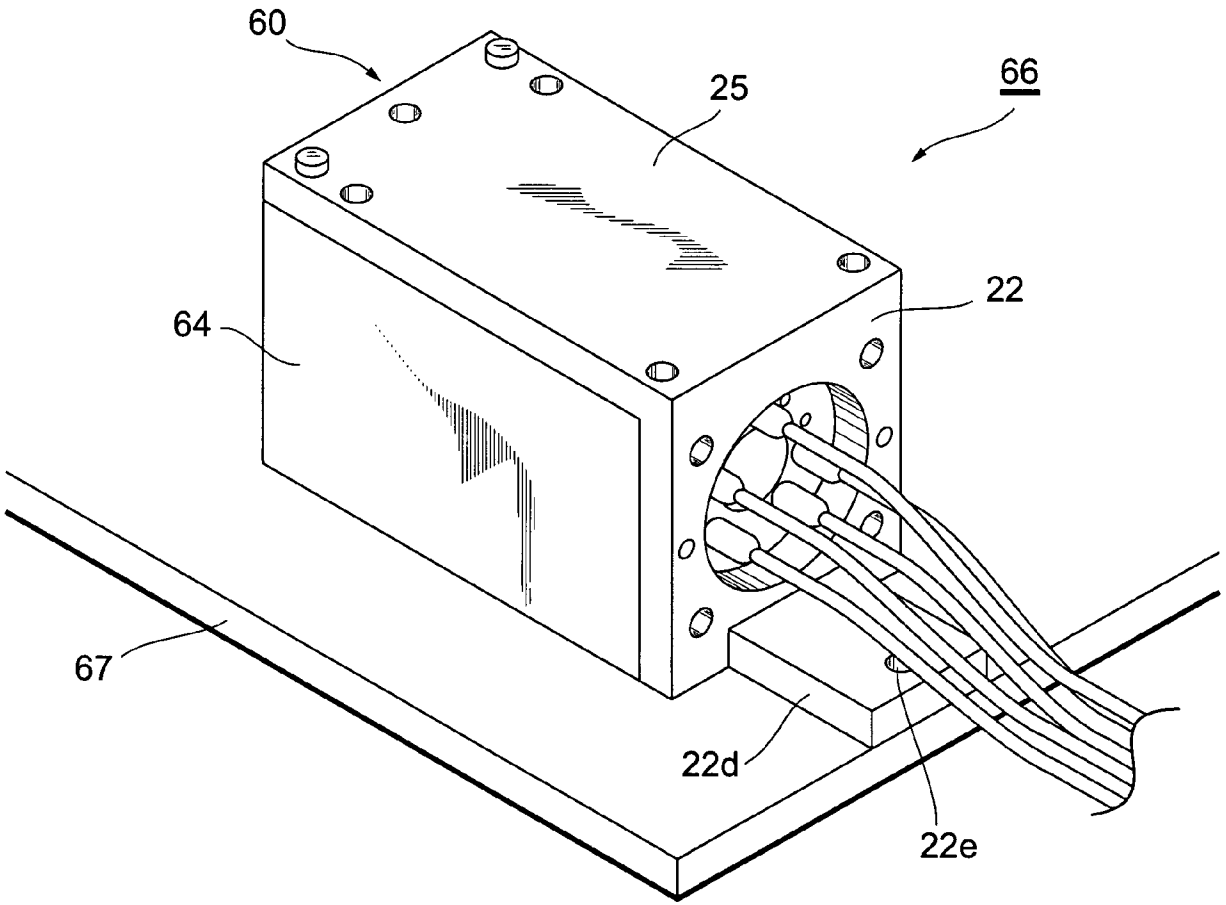
FIG. 14 is a perspective view of a structure of a lamp box of a fourth embodiment of a light source apparatus according to the present invention.
Figure 15:
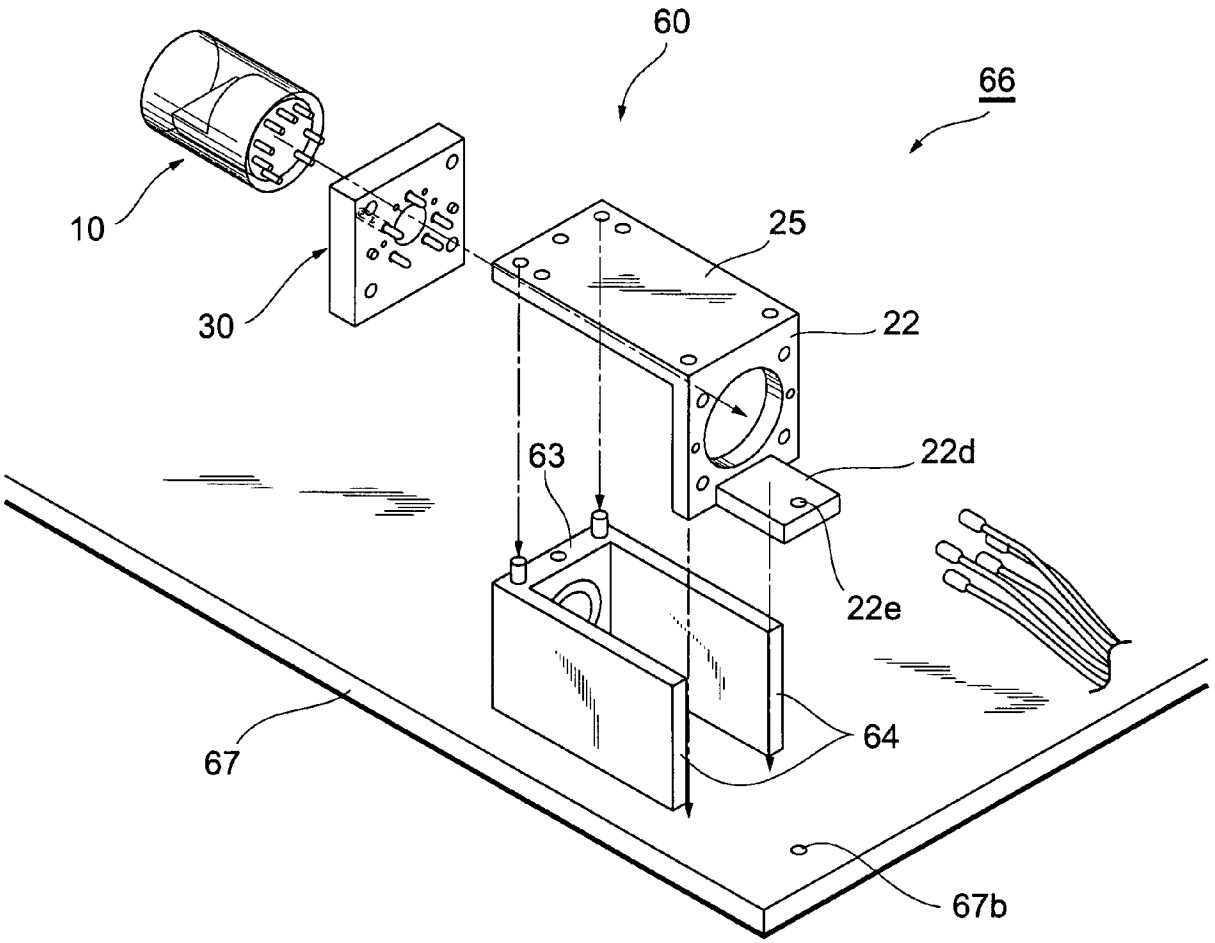
FIG. 15 is an exploded perspective view of an internal state of the lamp box (internal state in which the deuterium lamp is housed) of FIG. 14.

A fourth embodiment of a light source apparatus according to the present invention shall now be described with reference to FIGS. 14 and 15. FIG. 14 is a perspective view of a structure of a lamp box of the fourth embodiment of a light source apparatus according to the present invention. FIG. 15 is an exploded perspective view of an internal state of the lamp box (internal state in which the deuterium lamp is housed) of FIG. 14.

A point of difference of a light source apparatus 66 according to the fourth embodiment with respect to the light source apparatus 56 according to the third embodiment is that in place of the lamp box 50, with which the side surface plates 54, the bottom plate 51, and the light emitting plate 53 constitute an integral member, a lamp box 60 is applied with which the light emitting plate 63 and the side surface plates 64 constitute an integral member and a base 67 serves in common as the bottom plate. Whereas the light emitting plate 63 and the side surface plates 64 have the same structure as the light emitting plate 53 and the side surface plates 54 of the third embodiment, the heat insulating materials 27, positioned on the bottom plate 51, are lacking. The base 67 has the same structure as the base 7, and a female thread portion 67*b* for fixing the lamp fixing plate 22 is formed at a position corresponding to the opening 22*e* of the extending portion 22*d* of the lamp fixing plate 22. The arrangement of the rest of the light source apparatus 66 according to the fourth embodiment is the same as that of the light source apparatus 1 according to the first embodiment, and even with this structure, the same actions and effects as the light source apparatus 1 according to the first embodiment are exhibited. In addition, because the base 67 serves in common as the bottom plate of the lamp box 60, the number of parts is reduced further.

Figure 16:
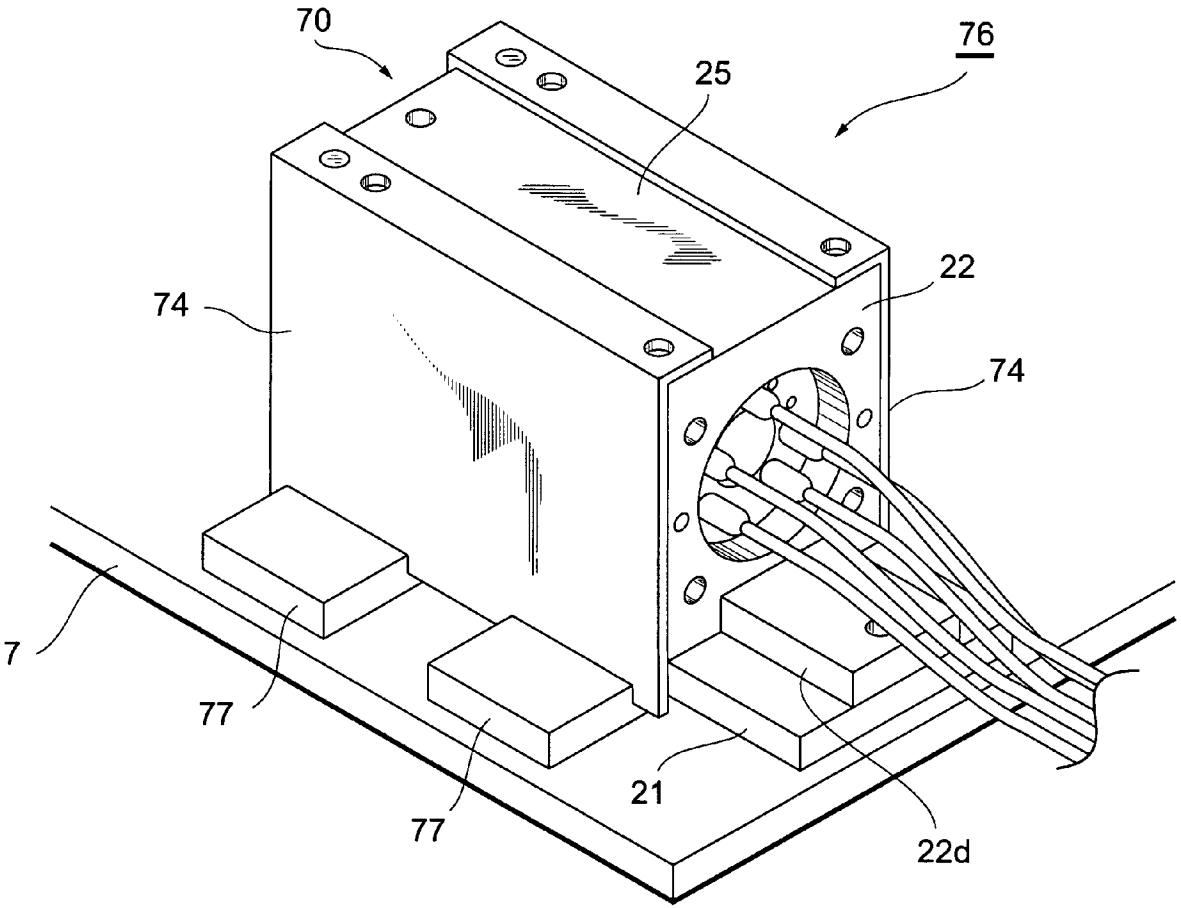
FIG. 16 is a perspective view of a structure of a lamp box of a fifth embodiment of a light source apparatus according to the present invention.
Figure 17:
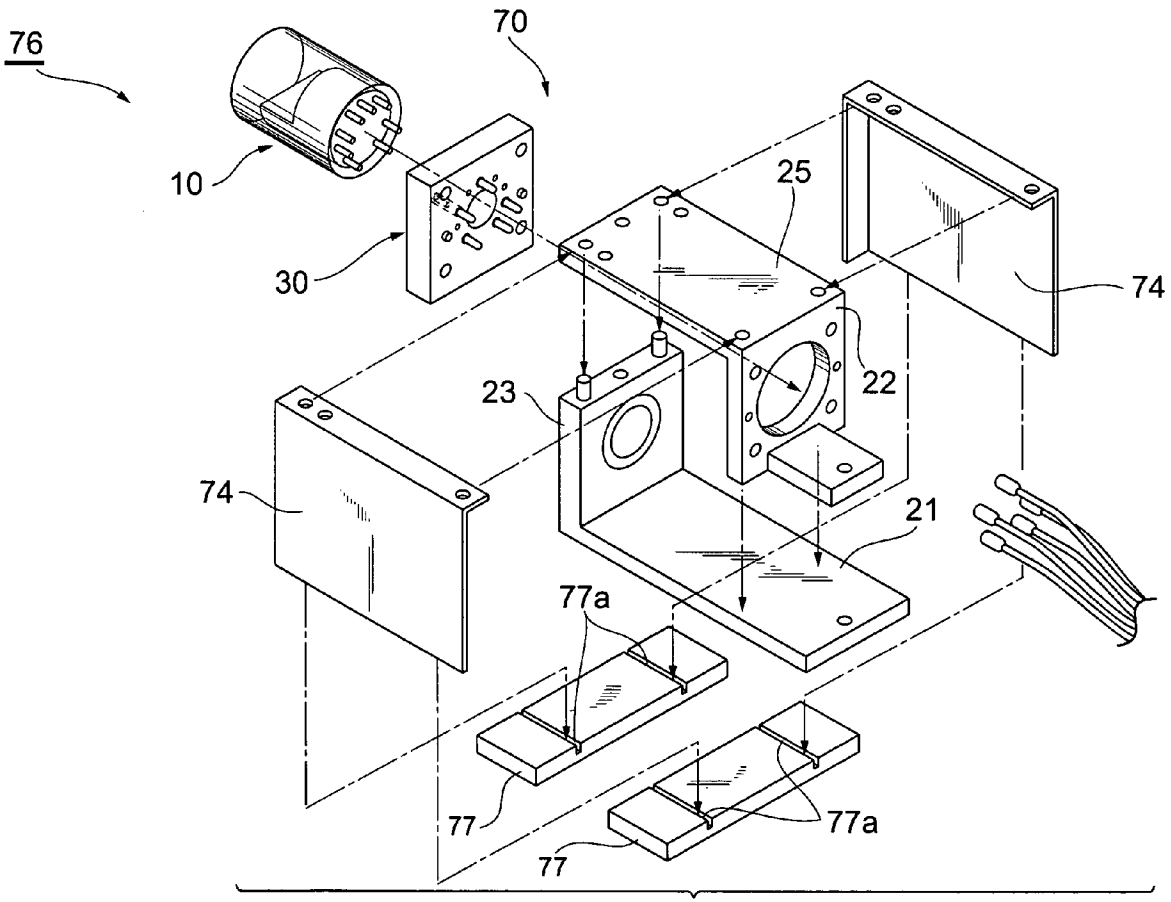
FIG. 17 is an exploded perspective view of an internal state of the lamp box (internal state in which the deuterium lamp is housed) of FIG. 16.

A fifth embodiment of a light source apparatus according to the present invention shall now be described with reference to FIGS. 16 and 17. FIG. 16 is a perspective view of a structure of a lamp box of the fifth embodiment of a light source apparatus according to the present invention. FIG. 17 is an exploded perspective view of an internal state of the lamp box (internal state in which the deuterium lamp is housed) of FIG. 16.

A point of difference of a light source apparatus 76 according to the fifth embodiment with respect to the light source apparatus 1 according to the first embodiment is that in place of the heat insulating materials 27, heat insulating materials 77, having grooves 77*a* which support the side surface plates 74, are applied and the plate spring 28 is made unnecessary. In comparison to the side surface plates 24 of the first embodiment, side surface plates 74 are longer in the vertical direction by amounts corresponding to the portions that fit into the grooves 77*a* and the lower ends protrude below the bottom plate 21. A lamp box 70, with which the lower ends of the side surface plates 74 are erected in the grooves 77*a* of the heat insulating materials 77, is thus obtained. The arrangement of the rest of the light source apparatus 76 according to the fifth embodiment is the same as that of the light source apparatus 1 according to the first embodiment, and even with this structure, the same actions and effects as the light source apparatus 1 according to the first embodiment are exhibited. In addition, because the plate spring 28 is made unnecessary, the number of parts is reduced further.

Figure 18:
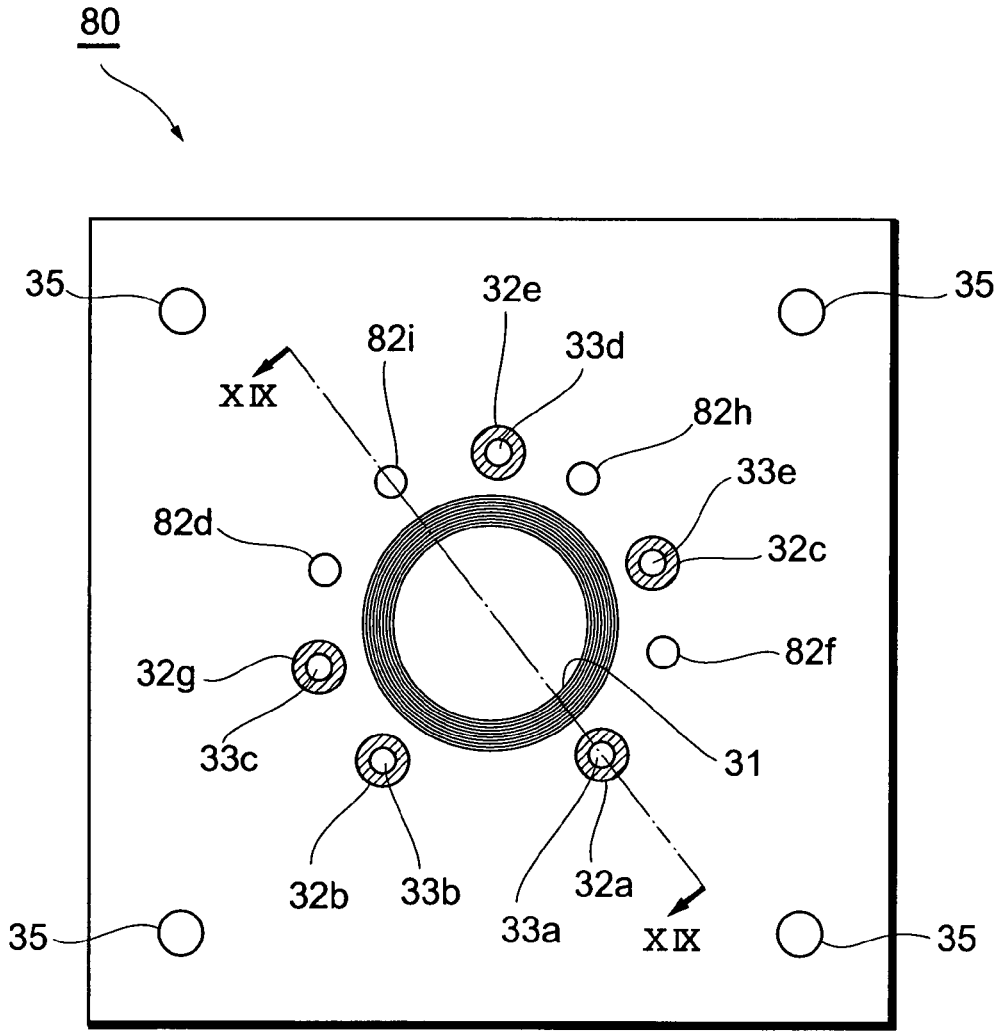
FIG. 18 is a front view of a structure of a heat insulating socket member in a sixth embodiment of a light source apparatus according to the present invention.
Figure 19:
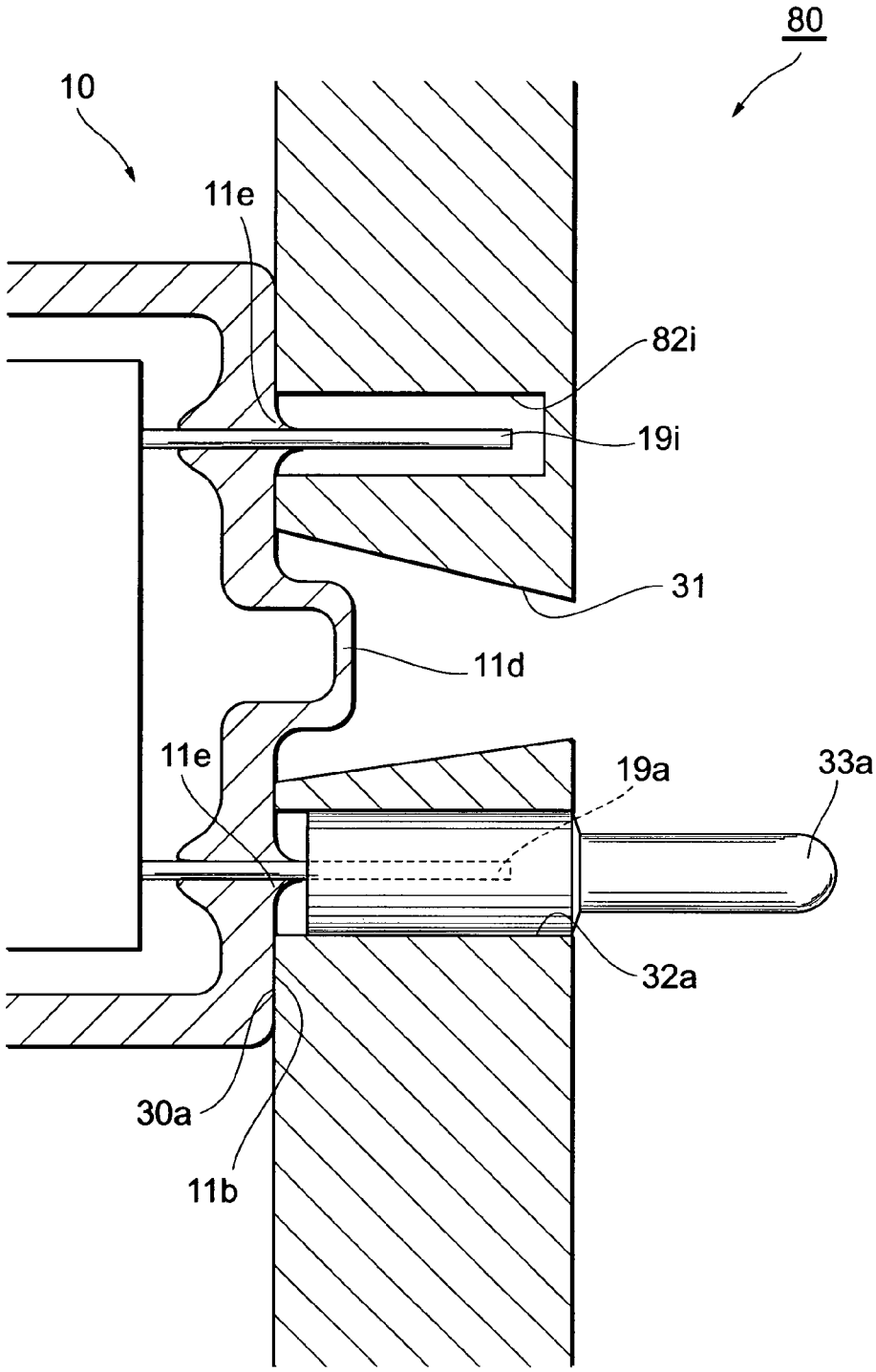
FIG. 19 is a diagram of a sectional structure along line XIX-XIX of the heat insulating socket (FIG. 18) in the state in which the deuterium lamp is fixed.

A sixth embodiment of a light source apparatus according to the present invention shall now be described with reference to FIGS. 18 and 19. FIG. 18 is a front view of a structure of a heat insulating socket member in the sixth embodiment of a light source apparatus according to the present invention. FIG. 19 is a diagram of a sectional structure along line XIX-XIX of the heat insulating socket (FIG. 18) in the state in which the deuterium lamp is fixed.

A point of difference of a light source apparatus according to the sixth embodiment with respect to the light source apparatus according to the first embodiment is that in place of the heat insulating socket member 30, provided with the stem pin entry portions 32*d*, 32*i*, 32*h*, and 32*f*, which are openings, the heat insulating socket member 80, provided with stem pin entry portions 82*d*, 82*i*, 82*h*, and 82*f*, which are recessed portions that are closed at the back side, is applied. The arrangement of the rest of the light source apparatus according to the sixth embodiment is the same as that of the light source apparatus 1 according to the first embodiment, and even with this structure, the same actions and effects as the light source apparatus 1 according to the first embodiment are exhibited. In addition, because the back sides of the stem pin entry portions 82*d*, 82*i*, 82*h*, and 82*f* are closed by the heat insulating member 80, the influence of temperature change, outside the lamp box 20, on the deuterium lamp 10 is reduced further.

Figure 20:
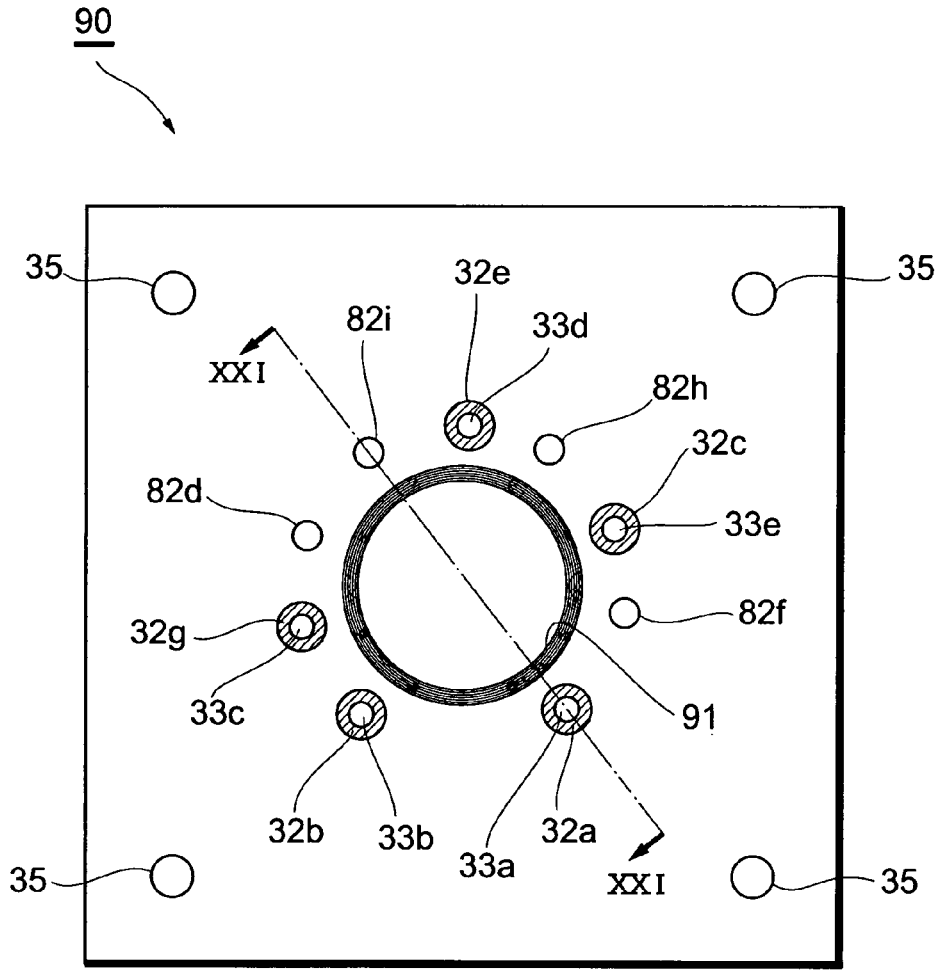
FIG. 20 is a front view of a structure of a heat insulating socket member in a seventh embodiment of a light source apparatus according to the present invention.
Figure 21:
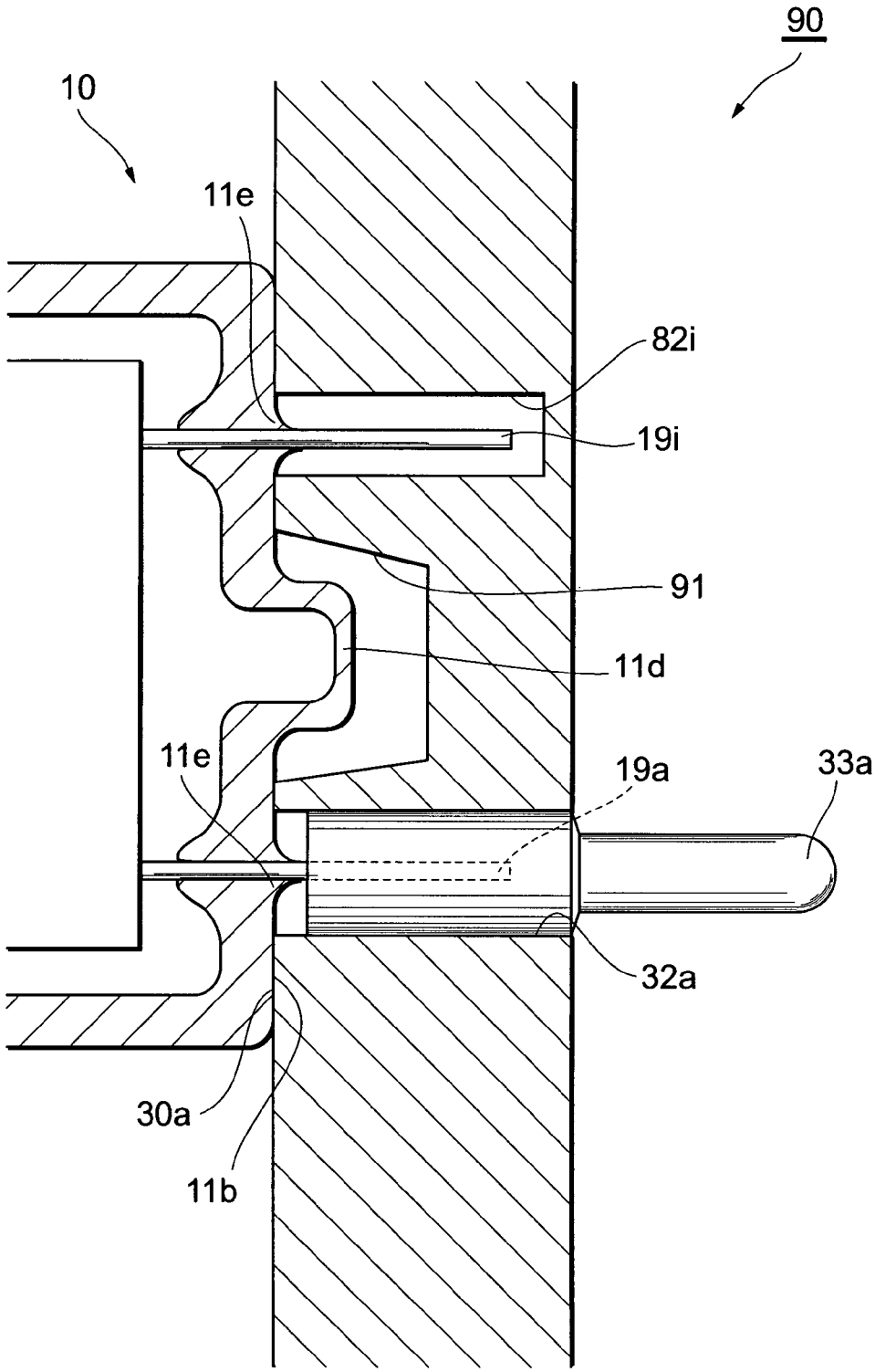
FIG. 21 is a diagram of a sectional structure along line XXI-XXI of the heat insulating socket (FIG. 20) in the state in which the deuterium lamp is fixed.

A seventh embodiment of a light source apparatus according to the present invention shall now be described with reference to FIGS. 20 and 21. FIG. 20 is a front view of a structure of a heat insulating socket member in the seventh embodiment of a light source apparatus according to the present invention. FIG. 21 is a diagram of a sectional structure along line XXI-XXI of the heat insulating socket (FIG. 20) in the state in which the deuterium lamp is fixed.

A point of difference of a light source apparatus according to the seventh embodiment with respect to the light source apparatus according to the sixth embodiment is that in place of the heat insulating socket member 80, provided with the evacuation tube entry portion 31, which is an opening, the heat insulating socket member 90, provided with an evacuation tube entry portion 91, which is a recessed portion that is closed at the back side, is applied. The arrangement of the rest of the light source apparatus according to the seventh embodiment is the same as that of the light source apparatus 1 according to the first embodiment, and even with this structure, the same actions and effects as the light source apparatus 1 according to the first embodiment and the light source apparatus according to the sixth embodiment are exhibited. In addition, because the back side of the evacuation tube entry portion 91 is closed by the heat insulating member 90, the influence of temperature change, outside the lamp box 20, on the deuterium lamp 10 is reduced further.

Figure 22:
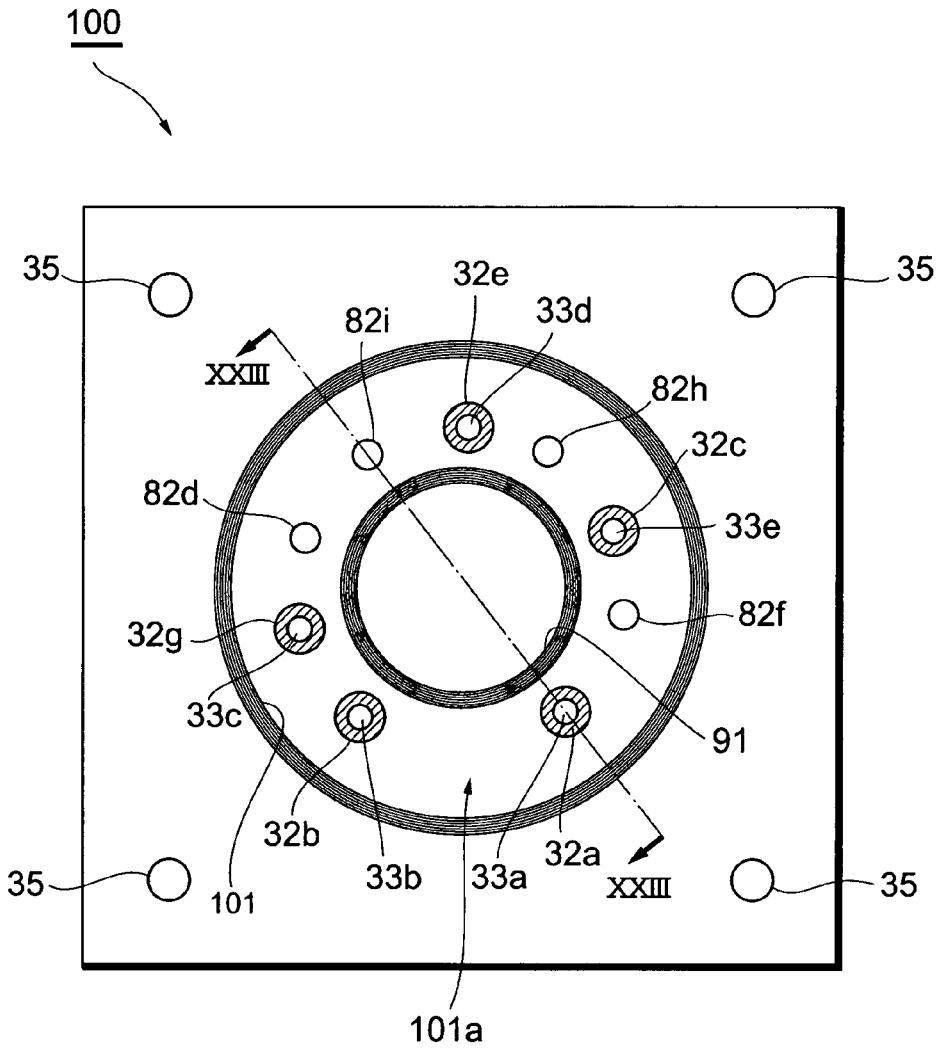
FIG. 22 is a front view of a structure of a heat insulating socket member in an eighth embodiment of a light source apparatus according to the present invention.
Figure 23:
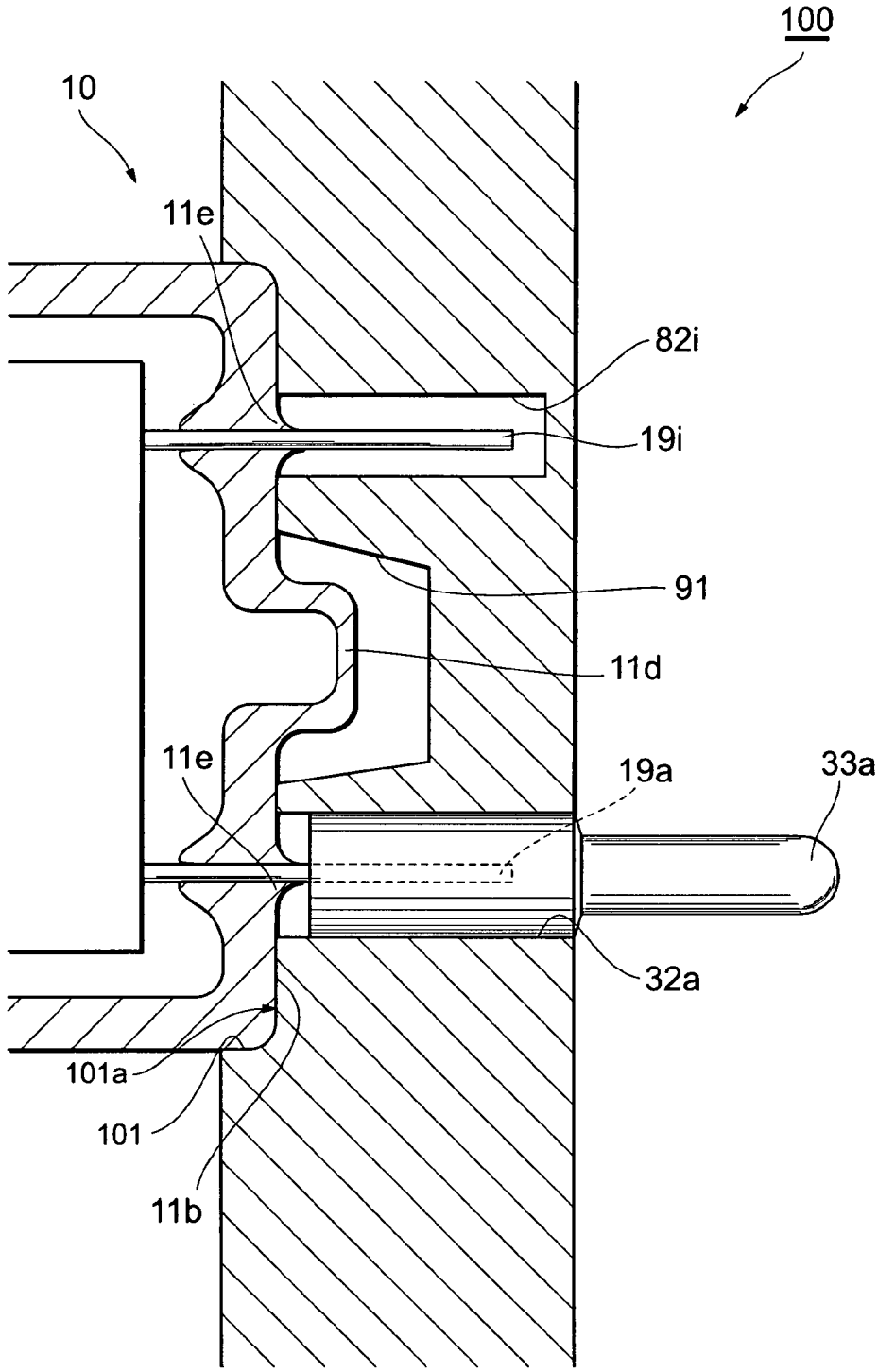
FIG. 23 is a diagram of a sectional structure along line XXIII-XXIII of the heat insulating socket (FIG. 22) in the state in which the deuterium lamp is fixed.

An eighth embodiment of a light source apparatus according to the present invention shall now be described with reference to FIGS. 22 and 23. FIG. 22 is a front view of a structure of a heat insulating socket member in the eighth embodiment of a light source apparatus according to the present invention. FIG. 23 is a diagram of a sectional structure along line XXIII-XXIII of the heat insulating socket (FIG. 22) in the state in which the deuterium lamp is fixed.

A point of difference of a light source apparatus according to the eighth embodiment with respect to the light source apparatus according to the seventh embodiment is that the heat insulating socket member 100 has a first recessed portion 101 that houses the stem portion 11*b* of the deuterium lamp 10. The shape of the first recessed portion 101 in front view is circular, and the outer diameter thereof is of a size corresponding to the outer diameter of the stem portion 11*b*. A bottom surface 101*a* of the first recessed portion 101 is a flat surface. With the deuterium lamp 10, the evacuation tube portion 11*d* and the stem pins 19*a* to 19*i* enter inside the evacuation tube entry portion 91 and the stem pin entry portions 32*a*, 32*b*, 32*c*, 82*d*, 32*e*, 82*f*, 32*g*, 82*h*, and 82*i*, respectively, with the stem portion 11*b* being housed in the first recessed portion 101 as shown in FIG. 23. The stem portion 11*b* is thereby detachably fixed while being in plane contact with the bottom surface (plane contacting portion) 101*a* of the first recessed portion. The arrangement of the rest of the light source apparatus according to the eighth embodiment is the same as that of the light source apparatus 1 according to the first embodiment, and even with this structure, the same actions and effects as the light source apparatus 1 according to the first embodiment and the light source apparatus according to the seventh embodiment are exhibited. In addition, the stability upon fixing of the deuterium lamp 10 is improved in this eighth embodiment.

Figure 24:
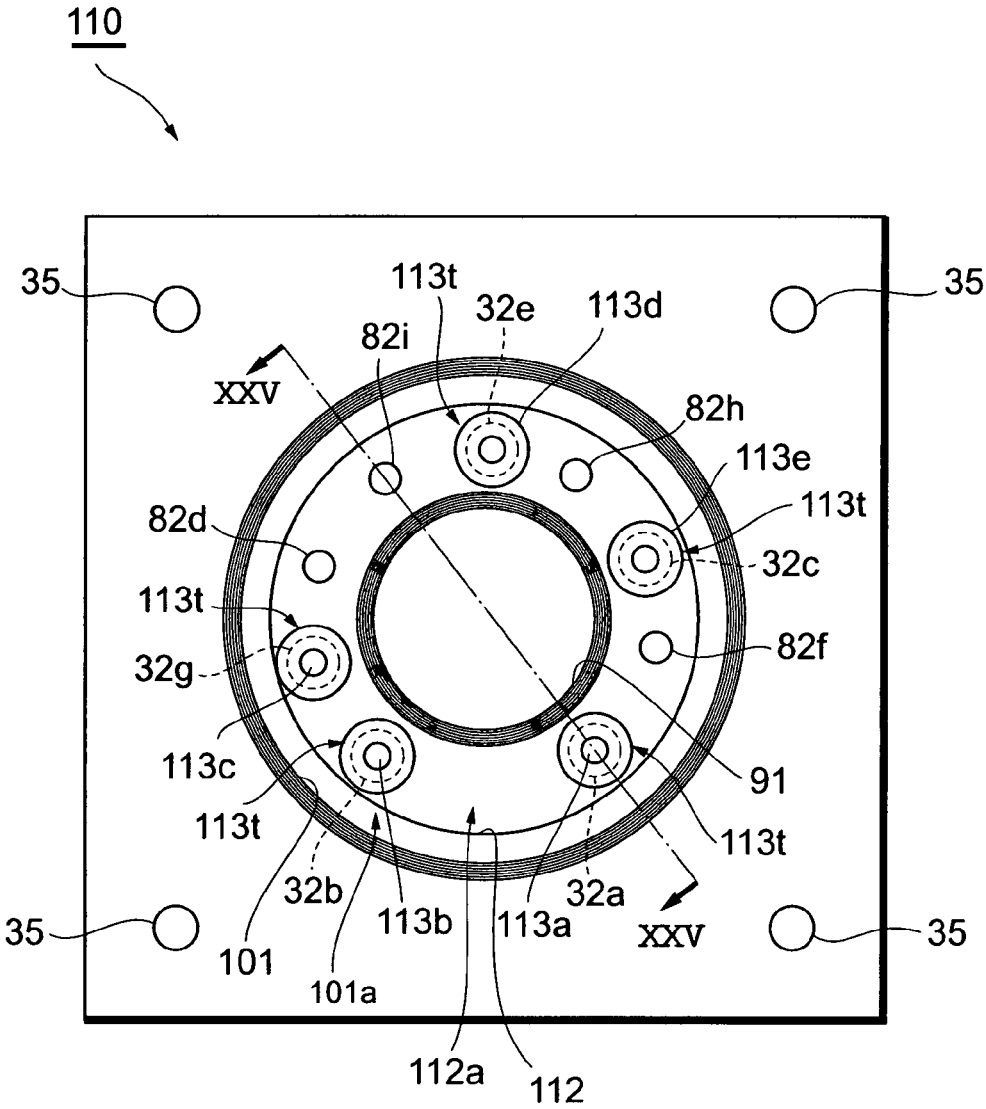
FIG. 24 is a front view of a structure of a heat insulating socket member in a ninth embodiment of a light source apparatus according to the present invention.
Figure 25:
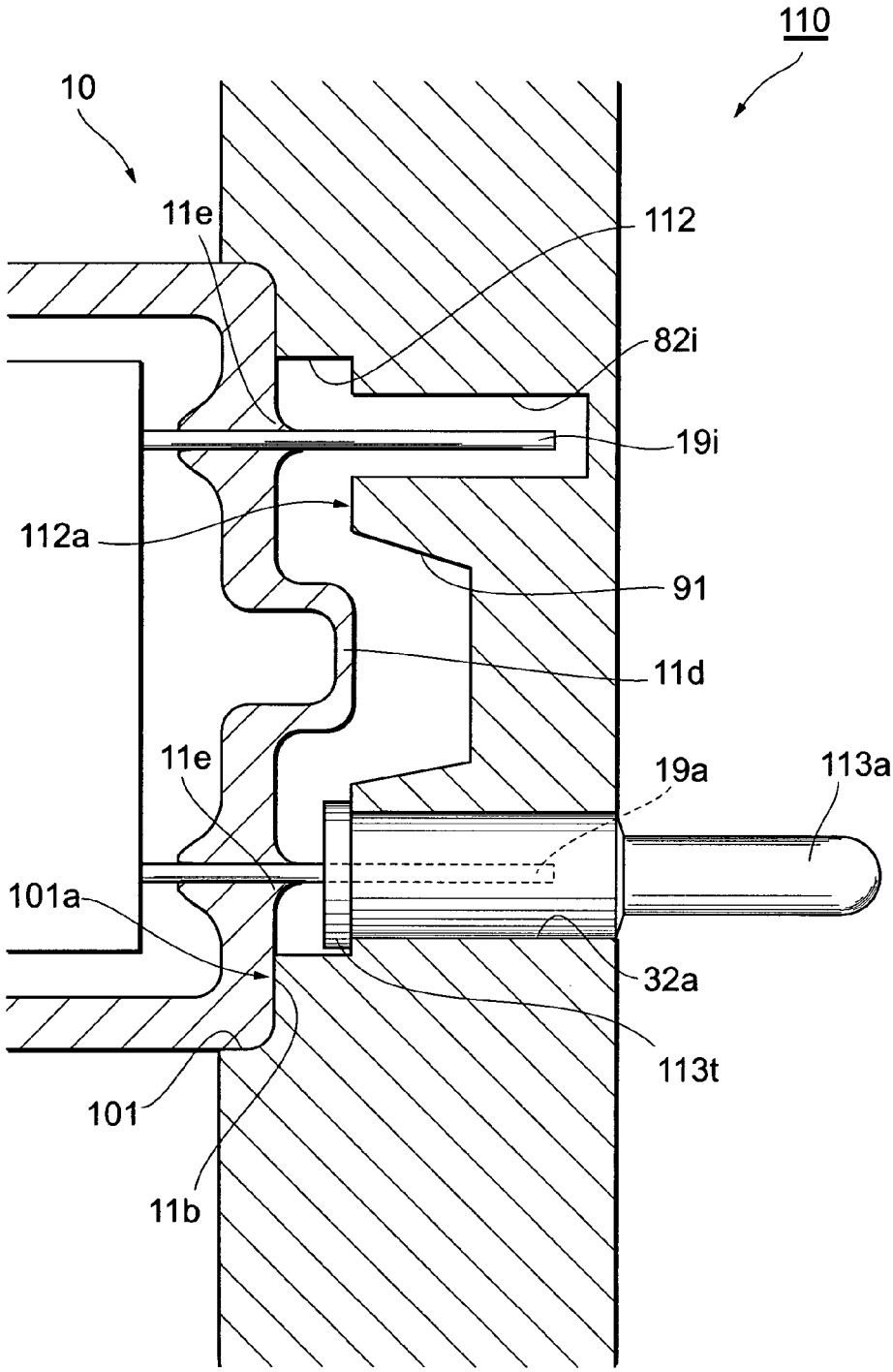
FIG. 25 is a diagram of a sectional structure along line XXV-XXV of the heat insulating socket (FIG. 24) in the state in which the deuterium lamp is fixed.

A ninth embodiment of a light source apparatus according to the present invention shall now be described with reference to FIGS. 24 and 25. FIG. 24 is a front view of a structure of a heat insulating socket member in the ninth embodiment of a light source apparatus according to the present invention. FIG. 25 is a diagram of a sectional structure along line XXV-XXV of the heat insulating socket (FIG. 24) in the state in which the deuterium lamp is fixed.

A point of difference of a light source apparatus according to the ninth embodiment with respect to the light source apparatus according to the eighth embodiment is that the heat insulating socket member 110 has a second recessed portion 112 at the bottom surface 101*a* of the first recessed portion 101 and that pin socket members 113*a* to 113*e*, provided with collar portions 113*t* that become latched onto circumferential edge portions at the front sides of the stem pin entry portions 32*a*, 32*b*, 32*g*, 32*e*, and 32*c*, are provided. The shape of the second recessed portion 112 in front view is circular and the outer circumference thereof is positioned at the outer sides of the stem pin entry portions 32*a*, 32*b*, 32*c*, 82*d*, 32*e*, 82*f*, 32*g*, 82*h*, and 82*i*. The pin socket members 113*a* to 113*e* are inserted into the stem pin entry portions 32*a*, 32*b*, 32*g*, 32*e*, and 32*c* and the collar portions 113*t* are latched to a bottom surface 112*a* of the second recessed portion 112. The arrangement of the rest of the light source apparatus according to the ninth embodiment is the same as that of the light source apparatus 1 according to the first embodiment, and even with this structure, the same actions and effects as the light source apparatus 1 according to the first embodiment and the light source apparatus according to the eighth embodiment are exhibited.

Figure 26:
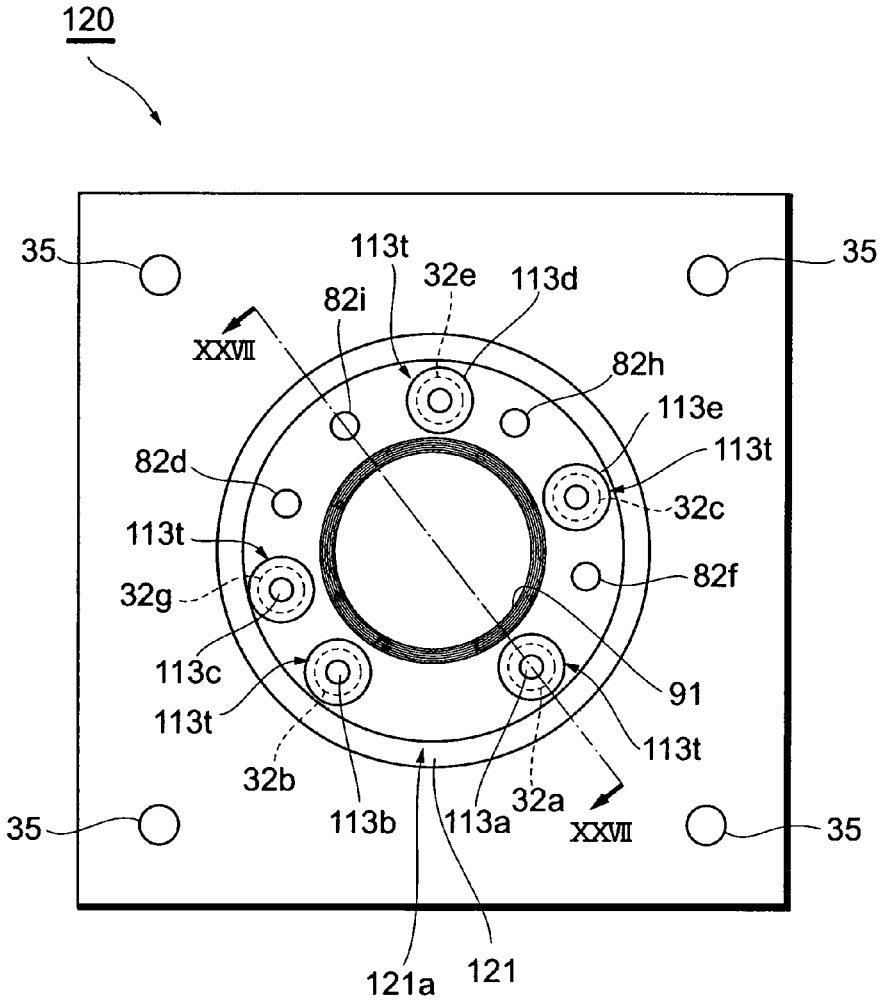
FIG. 26 is a front view of a structure of a heat insulating socket member in a tenth embodiment of a light source apparatus according to the present invention.
Figure 27:
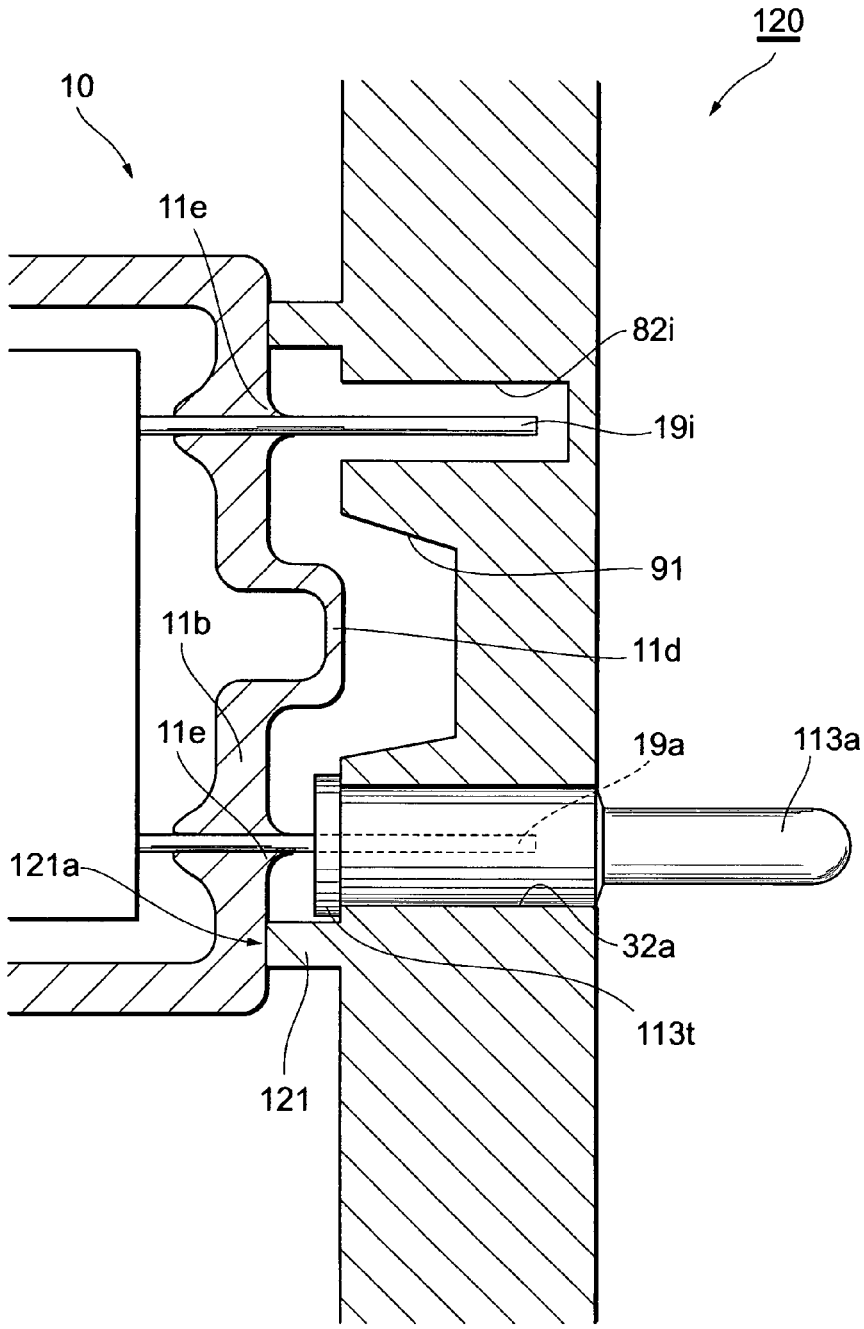
FIG. 27 is a diagram of a sectional structure along line XXVII-XXVII of the heat insulating socket (FIG. 26) in the state in which the deuterium lamp is fixed.

A tenth embodiment of a light source apparatus according to the present invention shall now be described with reference to FIGS. 26 and 27. FIG. 26 is a front view of a structure of a heat insulating socket member in the tenth embodiment of a light source apparatus according to the present invention. FIG. 27 is a diagram of a sectional structure along line XXVII-XXVII of the heat insulating socket (FIG. 26) in the state in which the deuterium lamp is fixed.

A point of difference of a light source apparatus according to the tenth embodiment with respect to the light source apparatus according to the seventh embodiment is that the heat insulating socket member 120 has an upright portion 121 that has an annular form and protrudes toward the front side and that the pin socket members 113*a* to 113*e*, provided with the collar portions 113*t* that become latched onto circumferential edge portions at the front sides of the stem pin entry portions 32*a*, 32*b*, 32*g*, 32*e*, and 32*c*, are provided. The pin socket members 113*a* to 113*e* have the same structure as the pin socket members 113*a* to 113*e* of the ninth embodiment.

The upright portion 121 is positioned at the outer side of the stem pin entry portions 32*a*, 32*b*, 32*c*, 82*d*, 32*e*, 82*f*, 32*g*, 82*h*, and 82*i*. The pin socket members 113*a* to 113*e* are inserted and attached in the stem pin entry portions 32*a*, 32*b*, 32*g*, 32*e*, and 32*c* and the collar portions 113*t* are latched to a front surface of the heat insulating socket member 120. The deuterium lamp 10 is detachably fixed to the heat insulating socket member 120. Specifically, as shown in FIG. 27, the stem portion 11*b* is put in plane contact with an end surface (plane contacting portion) 121*a* of the upright portion 121 and the evacuation tube portion 11*d* and the stem pins 19*a* to 19*i* are respectively inserted in the evacuation tube entry portion 91 and the stem pin entry portions 32*a*, 32*b*, 32*c*, 82*d*, 32*e*, 82*f*, 32*g*, 82*h*, and 82*i*. The arrangement of the rest of the light source apparatus according to the tenth embodiment is the same as that of the light source apparatus 1 according to the first embodiment, and even with this structure, the same actions and effects as the light source apparatus 1 according to the first embodiment and the light source apparatus according to the seventh embodiment are exhibited.

Figure 28:
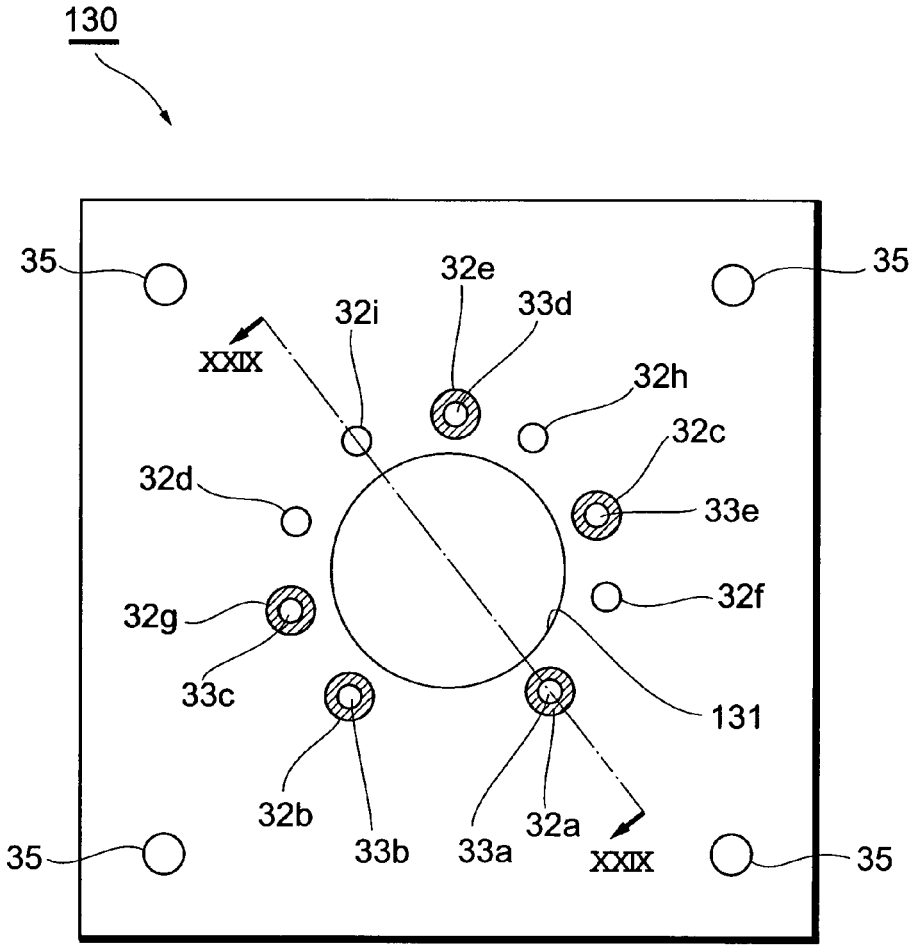
FIG. 28 is a front view of a structure of a heat insulating socket member in an eleventh embodiment of a light source apparatus according to the present invention.
Figure 29:
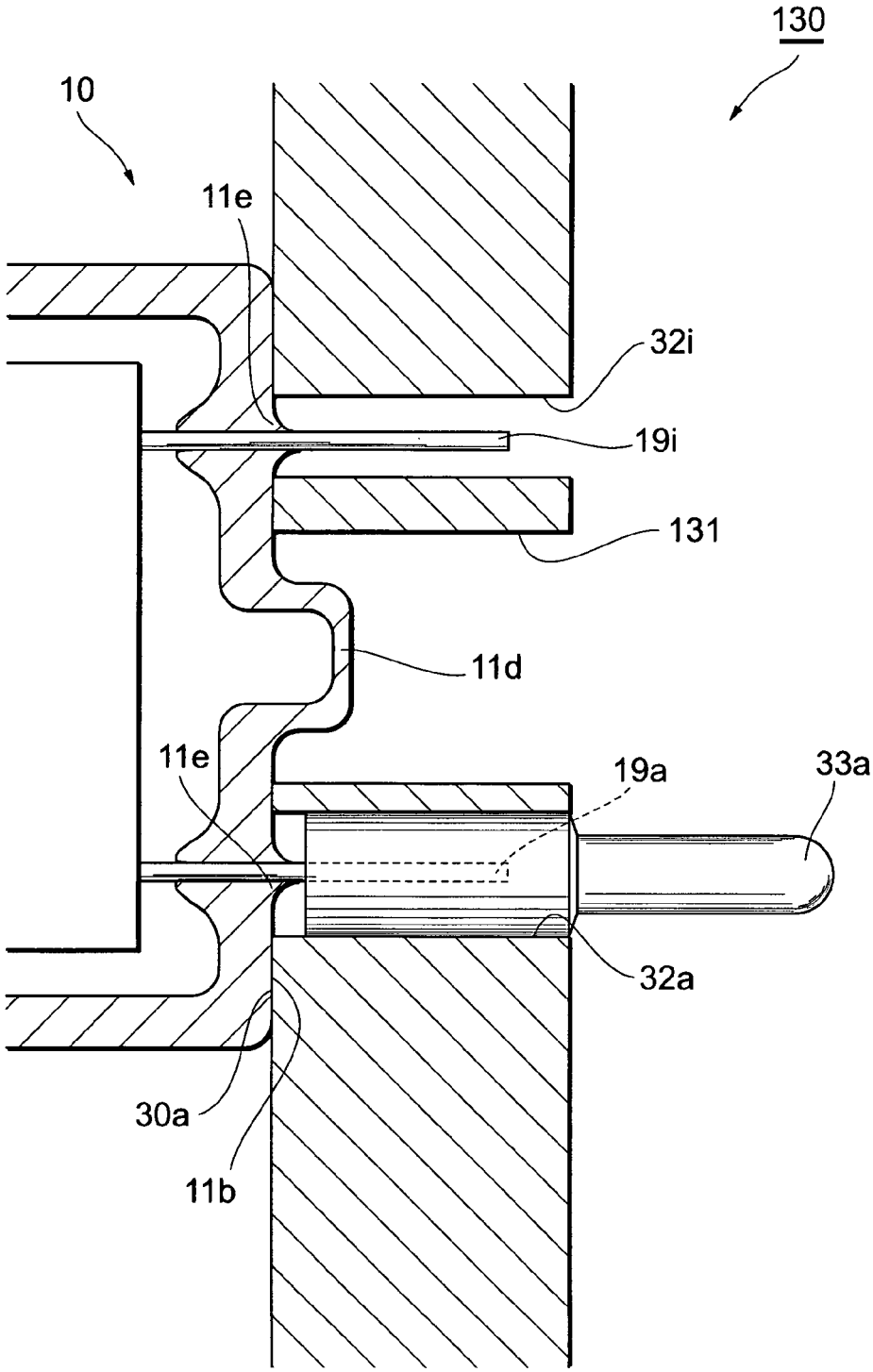
FIG. 29 is a diagram of a sectional structure along line XXIX-XXIX of the heat insulating socket (FIG. 28) in the state in which the deuterium lamp is fixed.

An eleventh embodiment of a light source apparatus according to the present invention shall now be described with reference to FIGS. 28 and 29. FIG. 28 is a front view of a structure of a heat insulating socket member in the eleventh embodiment of a light source apparatus according to the present invention. FIG. 29 is a diagram of a sectional structure along line XXIX-XXIX of the heat insulating socket (FIG. 28) in the state in which the deuterium lamp is fixed.

A point of difference of a light source apparatus according to the eleventh embodiment with respect to the light source apparatus 1 according to the first embodiment is that in place of the heat insulating socket member 30, having the evacuation tube entry portion 31, the diameter of which increases from the back side to the front side, the heat insulating socket member 130, having an evacuation tube entry portion 131, the diameter of which is fixed from the back side to the front side, is applied. The arrangement of the rest of the light source apparatus according to the eleventh embodiment is the same as that of the light source apparatus 1 according to the first embodiment, and even with this structure, the same actions and effects as the light source apparatus 1 according to the first embodiment are exhibited.

Figure 30:
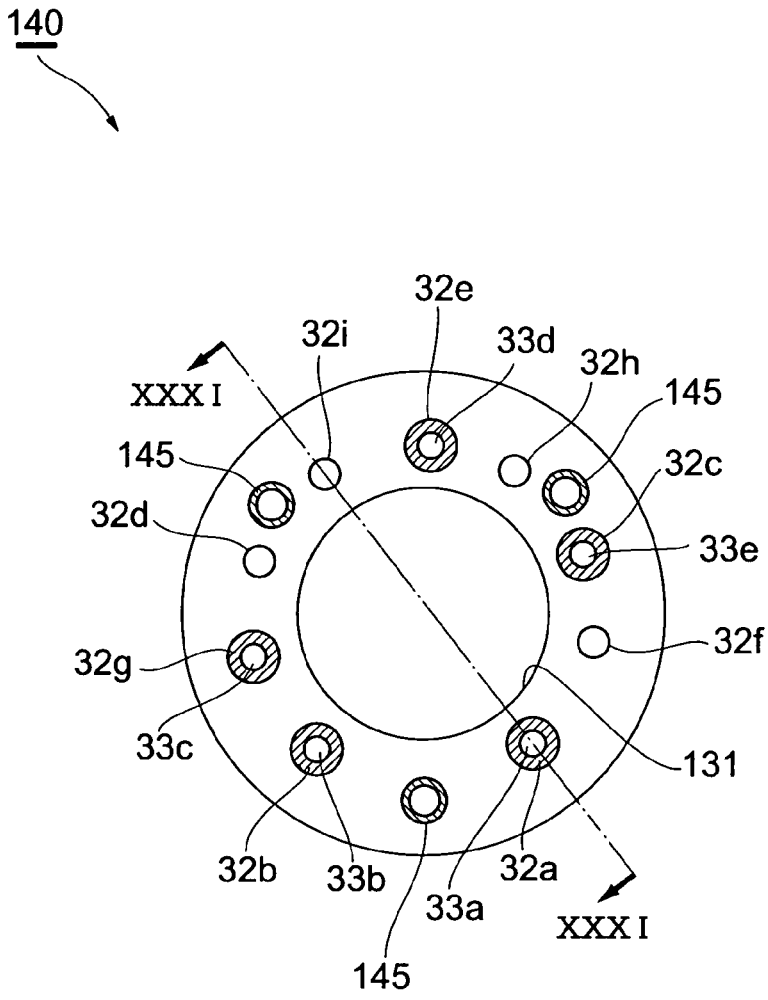
FIG. 30 is a front view of a structure of a heat insulating socket member in a twelfth embodiment of a light source apparatus according to the present invention.
Figure 31:
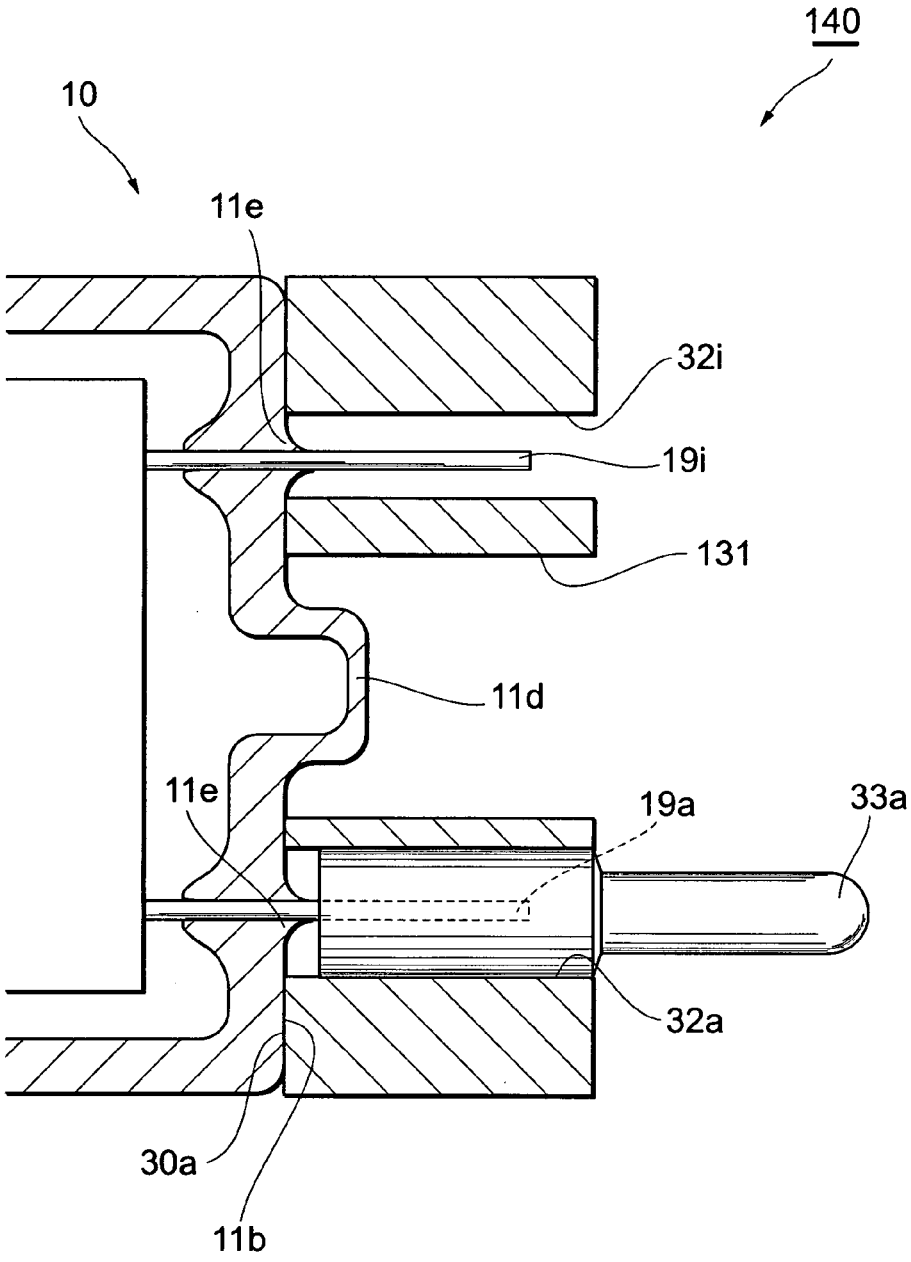
FIG. 31 is a diagram of a sectional structure along line XXXI-XXXI of the heat insulating socket (FIG. 30) in the state in which the deuterium lamp is fixed.

A twelfth embodiment of a light source apparatus according to the present invention shall now be described with reference to FIGS. 30 and 31. FIG. 30 is a front view of a structure of a heat insulating socket member in the twelfth embodiment of a light source apparatus according to the present invention. FIG. 31 is a diagram of a sectional structure along line XXXI-XXXI of the heat insulating socket (FIG. 30) in the state in which the deuterium lamp is fixed.

Points of difference of a light source apparatus according to the twelfth embodiment with respect to the light source apparatus according to the eleventh embodiment is that in place of the heat insulating socket member 130, having a rectangular outer shell shape, the heat insulating socket member 140, having a circular outer shell shape, is employed and that positions of openings 145 for insertion of male screws for fixing the heat insulating member 140 to the lamp fixing plate are changed. The outer diameter of the heat-socket member 140 has a size corresponding to the diameter of the stem portion 11*b*. The arrangement of the rest of the light source apparatus according to the twelfth embodiment is the same as that of the light source apparatus 1 according to the first embodiment, and even with this structure, the same actions and effects as the light source apparatus 1 according to the first embodiment and the light source apparatus according to the eleventh embodiment are exhibited.

Although the present invention was described specifically based on a plurality of embodiments above, the present invention is not restricted to the above-described embodiments. For example, although in the above-described embodiments, the lamp boxes 20, 40, 50, 60, and 70 all have a box-like shape, these may have a cylindrical shape or other shape instead.

Also, although the head-on type deuterium lamp 10 is indicated as the gas discharge tube in the above-described embodiments, a side-on type deuterium lamp may be used instead. In such a case, a light emitting portion is provided in a side surface plate 24, 54, 64, or 74. Other gas discharge tubes besides these may also be applied.

Furthermore, although in the above-described embodiments, the material of the heat insulating socket members 30, 80, 90, 100, 110, 120, 130, and 140 is a polyether ether ketone resin material, a heat insulating socket member, comprised of another material having a heat insulating property and an electrical insulating property, may be used instead.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

INDUSTRIAL APPLICABILITY

The light source apparatus according to the present invention is applicable to light sources of analyzing apparatuses, semiconductor inspection apparatuses, and various other inspection apparatuses.

The invention claimed is:

1. A light source apparatus comprising: a gas discharge tube generating light with a predetermined wavelength and having stem pins that protrude from a bottom surface thereof; a lamp container housing said gas discharge tube; and a base having a surface on which said lamp container is fixed, wherein said lamp container comprises:

a lamp fixing portion constituting a part of an outer shell of said lamp container;

a light emitting portion allowing light from said gas discharge tube housed therein to pass through toward the exterior of said lamp container;

a heat insulating member housed inside said lamp container, together with said gas discharge tube, said heat insulating member having a first surface being in direct contact with the bottom surface of said gas discharge tube, a second surface being in direct contact with an inner side surface of said lamp fixing portion, and through holes each communicating between the first and second surfaces and housing at least a part of said each stem pin, whereby said gas discharge tube is fixed to a predetermined position of the inner side surface of said lamp fixing portion via said heat insulating portion; and a first attachment/detachment structure enabling said lamp fixing portion, to which said gas discharge tube is fixed via said heat insulating portion, to be attached and detached, while said gas discharge tube being fixed thereto, with respect to a remaining portion that is fixed to said base and constitutes the outer shell of said lamp container together with said lamp fixing portion.

2. A light source apparatus according to claim 1, wherein said lamp container has a box-like shape, defined by: a lamp container base plate fixed to the base; a lamp fixing plate extending in a direction substantially orthogonal to said lamp container base plate and to which said gas discharge tube is fixed via said heat insulating member; a first wall surface plate disposed so as to oppose said lamp fixing plate across said gas discharge tube; and a second wall surface plate, disposed so as to oppose said lamp container base plate across said gas discharge tube, wherein said lamp fixing portion is constituted by said lamp fixing plate and said second wall surface plate, and wherein said first attachment/detachment structure enables said lamp fixing portion to be attached and detached, while said gas discharge tube being fixed via said heat insulating member, with respect to said lamp container base plate and the first wall surface plate in the direction substantially orthogonal to said lamp container base plate.

3. A light source apparatus according to claim 2, wherein said lamp container further comprises:

a pair of third wall surface plates disposed so as to be substantially orthogonal to said second wall surface plate and said lamp fixing plate while opposing each other across said gas discharge tube; and a second attachment/detachment structure enabling said pair of third wall surface plates to be attached and detached, with respect to said second wall surface plate and said lamp fixing plate.

4. A light source apparatus according to claim 1, further comprising a lens disposed at said light emitting portion that transmits light from said gas discharge tube.

5. A light source apparatus according to claim 1, wherein said heat insulating member has a plate-like shape.

* * * * *